US009111525B1

(12) United States Patent
Mouchtaris et al.

(10) Patent No.: US 9,111,525 B1
(45) Date of Patent: Aug. 18, 2015

(54) APPARATUSES, METHODS AND SYSTEMS FOR AUDIO PROCESSING AND TRANSMISSION

(75) Inventors: Athanasios Mouchtaris, Filothei (GR); Panagiotis Tsakalides, Heraklion (GR)

(73) Assignee: Foundation for Research and Technology—Hellas (FORTH) Institute of Computer Science (ICS), Heraklion (GR)

( * ) Notice: Subject to any disclaimer, the term of this patent is extended or adjusted under 35 U.S.C. 154(b) by 1424 days.

(21) Appl. No.: 12/242,020

(22) Filed: Sep. 30, 2008

Related U.S. Application Data

(60) Provisional application No. 61/028,786, filed on Feb. 14, 2008.

(51) Int. Cl.
*G10L 19/008* (2013.01)

(52) U.S. Cl.
CPC ..... *G10L 19/008* (2013.01)

(58) Field of Classification Search
USPC ..... 381/17, 18, 19, 80, 22–23; 704/205–210, 500; 700/94
See application file for complete search history.

(56) References Cited

U.S. PATENT DOCUMENTS

| | | | | |
|---|---|---|---|---|
| 5,886,276 | A * | 3/1999 | Levine et al. | 84/603 |
| 7,573,912 | B2 * | 8/2009 | Lindblom | 370/487 |
| 7,781,665 | B2 * | 8/2010 | Szczerba et al. | 84/622 |
| 7,805,313 | B2 * | 9/2010 | Faller et al. | 704/500 |
| 8,065,139 | B2 * | 11/2011 | Kot | 704/211 |
| 2001/0032087 | A1 * | 10/2001 | Oomen et al. | 704/500 |
| 2007/0127733 | A1 * | 6/2007 | Henn et al. | 381/80 |
| 2008/0037795 | A1 * | 2/2008 | Ko et al. | 381/17 |
| 2008/0212784 | A1 * | 9/2008 | Szczerba et al. | 381/1 |
| 2008/0294445 | A1 * | 11/2008 | Lee et al. | 704/500 |
| 2009/0106030 | A1 * | 4/2009 | Den Brinker et al. | 704/500 |

OTHER PUBLICATIONS

Faller et al, Spatial Decomposition of Time-Frequency Regions: Subbands or Sinusoids, AES,2004.*
Heusdens et al, Bit-Rate Scalable Intraframe Sinusoidal Audio Coding Based on Rate Distortion Optimization, AES 2005.*
Thornburg et al, A Flexible Resynthesis Approach for Quasi Harmonic Sounds, AES 2003.*
Karadimou et al, Multichannel Audio Modelling and Coding Using a Multiband Source Filter Model, IEEE 2005.*

(Continued)

*Primary Examiner* — Davetta W Goins
*Assistant Examiner* — Kuassi Ganmavo
(74) *Attorney, Agent, or Firm* — Chadbourne & Parke LLP

(57) ABSTRACT

This disclosure details the implementation of apparatuses, methods and systems for audio processing and transmission. Some implementations of the system are configured to provide a method for encoding an arbitrary number of audio source signals using only a small amount of (transmitted or stored) information, while facilitating high-quality audio playback at the decoder side. Some implementations may be configured to implement, a parametric model for retaining the essential information of each source signal (side information). After the side information is extracted, the remaining information for all source signals may be summed to create a reference signal from which noise information for the original source signals may be reconstructed. The reference signal and the side information form the new collection of information to be transmitted or stored for subsequent decoding.

30 Claims, 12 Drawing Sheets

(56) References Cited

OTHER PUBLICATIONS

Nsabimana et al, Transient encoding of audio signals using dyadic approximation, DAFX 2007.*
Ferreira, Perceptual coding using sinusoidal modeling in the MDCT domain, AES, 2002.*
J. Breebaart et al., "MPEG spatial audio coding/MPEG surround: Overview and current status," in Audio Engineering Society (AES)119th Convention, Paper 6599, Oct. 2005.
F. Baumgarte and C. Faller, "Binaural cue coding—Part I: Psychoacoustic fundamentals and design principles," IEEE Transactions on Speech and Audio Processing., pp. 509-519, vol. 11, No. 6, Nov. 2003.
C. Faller and F. Baumgarte, "Binaural cue coding—Part II: Schemes and applications," IEEE Transactions on Speech and Audio Processing, pp. 520-531, vol. 11, No. 6, Nov. 2003.
J. Breebaart et al., "Parametric coding of stereo audio," EURASIP Journal on Applied Signal Processing, pp. 1305-1322, vol. 9, 2005.
J. Herre and S. Disch, "New concepts in parametric coding of spatial audio: From SAC to SAOC," in IEEE International Conference on Multimedia Expo (ICME), pp. 1894-1897, Jul. 2007.
M. Wolters et al., "A closer look into MPEG-4 high efficiency AAC," in Audio Engineering Society (AES) 115th Convention, Preprint No. 5871, Oct. 2003.
M. M. Goodwin and J.-M. Jot, "A frequency domain framework for spatial audio coding based on universal spatial cues," in Audio Engineering Society (AES) 120th Convention, Preprint No. 6751, May 2006.
E. Gallo and N. Tsingos, "Extracting and re-rendering structured auditory scenes from field recordings," in Audio Engineering Society (AES)30th International Conference, Mar. 2007.
Y. Haraguchi et al., "Source-oriented localization control of stereo audio signals based on blind source separation," in IEEE International Conference on Acoustics, Speech, and Signal Processing (ICASSP), pp. 177-180, Apr. 2008.
M. Goodwin, "Multichannel matching pursuit and applications to spatial audio coding," in 40th Annual Asilomar Conference on Signals, System Computing, pp. 1114-1118, Oct.-Nov. 2006.
A. Mouchtaris et al., "Multiresolution source/filter model for low bitrate coding of spot microphone signals," EURASIP J. Audio, Speech, and Music Processing, vol. 2008, Article ID 624321, doi:10.1155/2008/62432, 2008.

* cited by examiner

APPARATUSES, METHODS AND SYSTEMS FOR AUDIO PROCESSING AND TRANSMISSION

RELATED APPLICATIONS AND PRIORITY CLAIMS

This is a Non-Provisional of prior Provisional application Ser. No. 61/028,786, filed Feb. 14, 2008, entitled, "Apparatuses, Methods and Systems for Audio Processing and Transmission", to which priority under 35 U.S.C. §119 is claimed. The entire contents of this Provisional application are herein expressly incorporated by reference.

FIELD

The elements for Audio Processing/Transmission ("APT") described herein are directed generally to apparatuses, methods, and systems for audio processing and transmission and, more particularly, to features that improve the efficiency of audio data transmission.

BACKGROUND

Multichannel audio has increased in popularity over stereophonic sound systems because it offers significant advantages to audio reproduction when compared to stereo sound (e.g., 2-channel audio systems). The large number of channels gives to the listener the sensation of being "surrounded" by sound and immerses him with a realistic acoustic scene.

SUMMARY

The following disclosure details various novel features and mechanisms for Audio Processing/Transmission ("APT"). An issue pertaining to the increased number of channels associated with multichannel audio is the demand for higher data rates facilitating modern storage and transmission activities. Some implementations of APT are configured to provide a method for encoding an arbitrary number of audio source signals using only a small amount of (transmitted or stored) information, while facilitating high-quality audio playback at the decoder side. Some implementations may be configured to implement a parametric model for retaining the essential information of each source signal (side information). After the side information is extracted, the remaining information for all source signals may be summed to create a new signal, which can be referred to as the "reference signal".

The reference signal and the side information form the new collection of information to be transmitted or stored. During decoding, the side information for each source signal may be used by the APT in conjunction with a source signal model to approximate the source signals. The side information may also be used to process the reference signal to yield error signals characteristic to each source signal. The sum of the source signal approximations and error signals then yields the decoded source signal, possibly with some coding error. Depending on the particular APT implementation, the source signals may include monophonic audio signals, such as various speech recordings, instrument recordings (e.g., spot recordings which are made during the recording of a performing ensemble), or a variety of other audio signals. The source signals do not necessarily need to contain common information. After the decoding, the APT may be configured to process these signals, which in turn may be mixed (creating a stereophonic or multichannel recording, which can subsequently be rendered through a stereophonic or multichannel audio system respectively), or directly rendered through headphones or loudspeakers (e.g. in a teleconferencing system).

The APT's extraction of the side information may be based on applying a sinusoidal model to the original source signal and extraction of the spectral envelope (e.g. by means of Linear Prediction Coefficients—LPC) from the sinusoidal error signal (the signal which is obtained by subtracting the sinusoidal signal from the original source signal). The side information that is retained at each time segment includes the sinusoidal parameters, the spectral envelopes and the corresponding power of the sinusoidal error signal. The remainder signals after extraction may then be added together in order to produce the reference signal.

BRIEF DESCRIPTION OF THE DRAWINGS

The accompanying appendices and/or drawings illustrate various non-limiting, example, inventive aspects in accordance with the present disclosure.

Figure 1A:
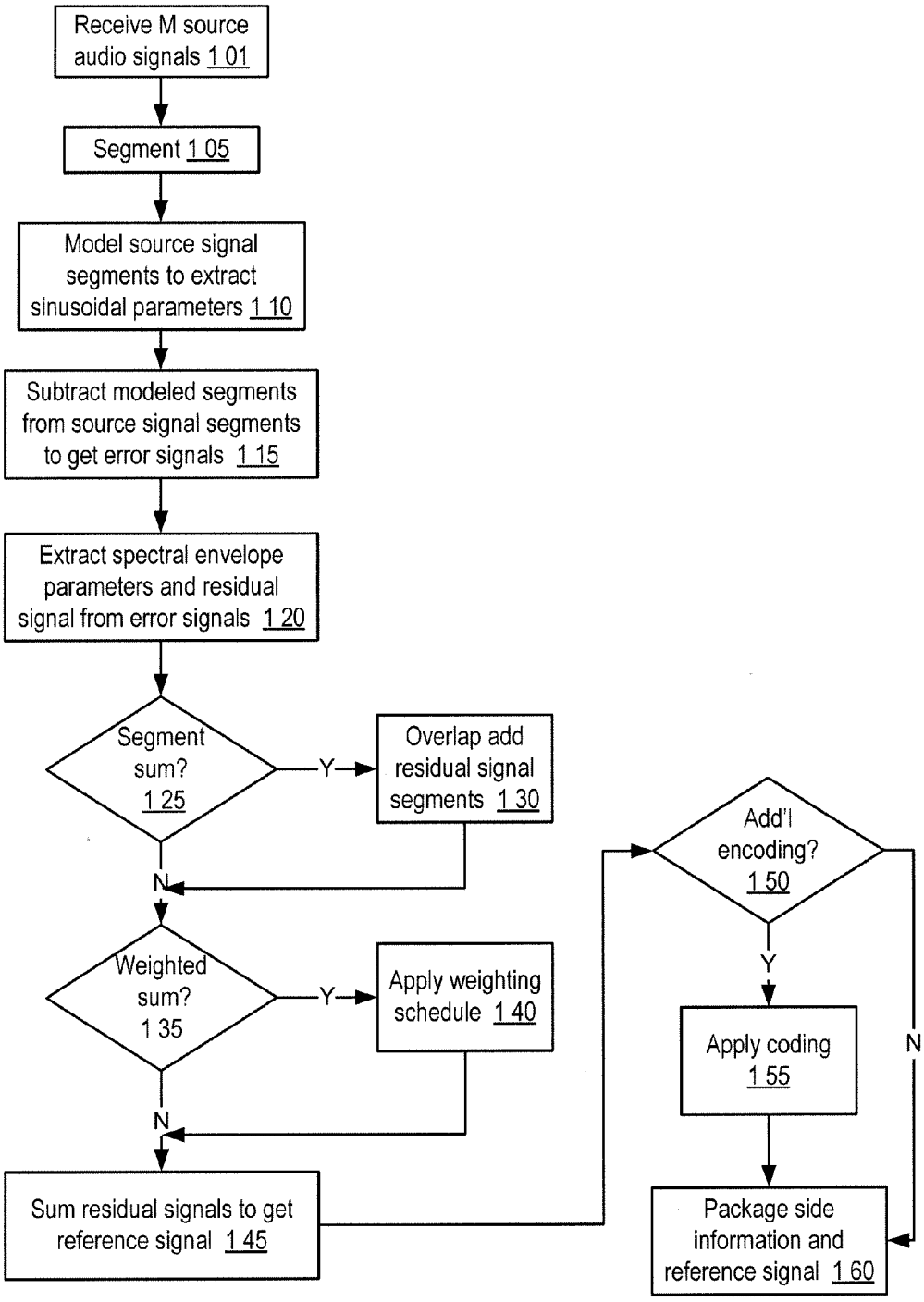
FIGS. 1A-1B show implementations of logic flow for encoding and decoding of audio signals in accordance with one embodiment of APT operation.

The leading number of each reference number within the drawings indicates the figure in which that reference number is introduced and/or detailed. As such, a detailed discussion of reference number 101 would be found and/or introduced in FIG. 1. Reference number 201 is introduced in FIG. 2, etc.

DETAILED DESCRIPTION

The following disclosure details various novel features and mechanisms for Audio Processing/Transmission ("APT"). Although the APT discussed herein may be configured to achieve a variety of applications, for the purposes of illustrating various functionality associated with the APT, aspects of the APT will be discussed below within the context of system implemented sinusoidal coding/de-coding of multiple monophonic audio signal processing and transmission. It should be noted, however, that APT features may be adapted to other data processing and/or encoding applications, may be applied to other forms of data (e.g., video), may employ other signal approximation models, and/or the like.

Aspects of the APT described herein may be configured to provide a method for encoding an arbitrary number of audio source signals using only a small amount of (transmitted or stored) information, while facilitating high-quality audio playback at the decoder side. Some implementations of the system may be configured with a parametric model that is used for retaining the essential information of each source signal (side information). After the side information is extracted, the remaining information for all source signals may be summed to create a new signal, which can be referred to as the "reference signal". The reference signal and the side information form the new collection of information to be transmitted or stored. During decoding, the side information for each source signal may be used to process the reference signal and extract the decoded version of each of the initially available source signals (possibly with some coding error).

The source signals may include a variety of audio signals including monophonic audio signals, such as various speech recordings, instrument recordings (e.g. spot recordings which are made during the recording of a performing ensemble) or a variety of other types of audio signals. There is no need for the source signals to contain common information. After the decoding, the APT may be configured to process and/or mix these signals (creating a stereophonic or multichannel recording, which may be subsequently rendered through a stereophonic or multichannel audio system respectively) or directly rendered through headphones or loudspeakers (e.g. in a teleconferencing system).

The APT extraction of the side information may, in one implementation, based on applying a sinusoidal model to the original source signal and extraction of the spectral envelope (e.g., by means of Linear Prediction Coefficients—"LPC") from the sinusoidal error signal (the signal which is obtained by subtracting the sinusoidal signal from the original source signal). The side information retained at each time segment includes the sinusoidal parameters, the spectral envelopes and the corresponding power of the sinusoidal error signal. The remainder signals after this procedure may then be added together in order to produce the reference signal.

The large number of channels in multi-channel audio production provides a listener with the sensation of being "surrounded" by sound and immerses the listener with a realistic acoustic scene. However, an increased number of channels corresponds with a demand for higher data rates with regard to data storage and data transmission purposes. Low-bandwidth applications (such as Internet streaming and wireless transmission) remain demanding, although some coding methods (MPEG, AAC, Dolby AC-3, etc.) achieve significant coding gains. However, conventional coding methods for low bit-rate applications generally result in significant audio quality degradation.

The APT facilitates reducing the transmission (and storage) requirements of spot microphone signals before the signals are processed or mixed into a final multichannel audio mix, by exploiting the similarities between such signals associated with the same multi-microphone recording. However, it is to be understood that the APT may be adapted to facilitate multichannel audio applications and may also be utilized to compress (for storage or transmission applications) multiple monophonic audio signals which must then be reconstructed at the decoder side with high audio quality (hereafter "audio source signals"). However, the APT facilitates significant design flexibility and it is to be understood that multiple source signals do not have to necessarily be similar or to come from the same multi-microphone recording.

The APT facilitates encoding/decoding multiple monophonic audio signals before the signals are mixed into a stereo or multichannel audio recording. In an implementation, the APT models each audio source signal with respect to a derived reference audio signal by employing a sinusoid plus noise model for each audio source signal and obtains both sinusoidal parameters (harmonic part) and short-time spectral envelope of the sinusoidal noise (the sinusoidal noise is the signal obtained by subtracting the sinusoidal signal from the original audio source signal) as side information per audio source signal. The remainder signal of this procedure is termed as the "residual" signal, and is in one view, the sinusoidal error signal of the audio source signal after its spectral envelope has been removed (e.g., using Linear Prediction Coefficient (LPC)—analysis the residual signal is the LPC error signal of the sinusoidal error signal).

In an implementation, the reference signal may be derived through the summation of all the residual signals of the corresponding audio source signals. This summation may be implemented as a weighted summation, using different weights for the residual of each audio source signal. For re-synthesis of each microphone signal, the harmonic part that was fully encoded may be added to the noise part which is recreated by using the noise envelopes to filter corresponding time segments of the reference channel. The APT facilitates this noise transplantation based on the harmonic part, which captures a significant part of each audio source signal even with a small number of sinusoids. Moreover, the APT achieves significant improvement in audio quality, through the use of the reference signal, even if the reference signal contains information from other audio source signals as well.

In some implementations, the APT achieves significant audio quality reproduction when the multiple audio source signals are rendered simultaneously (possibly after a mixing process such as in a multichannel audio setup). The APT applies the sinusoidal model in the context of collectively encoding multiple monophonic audio sources for low bit rate high-quality audio coding.

Figure 1B:
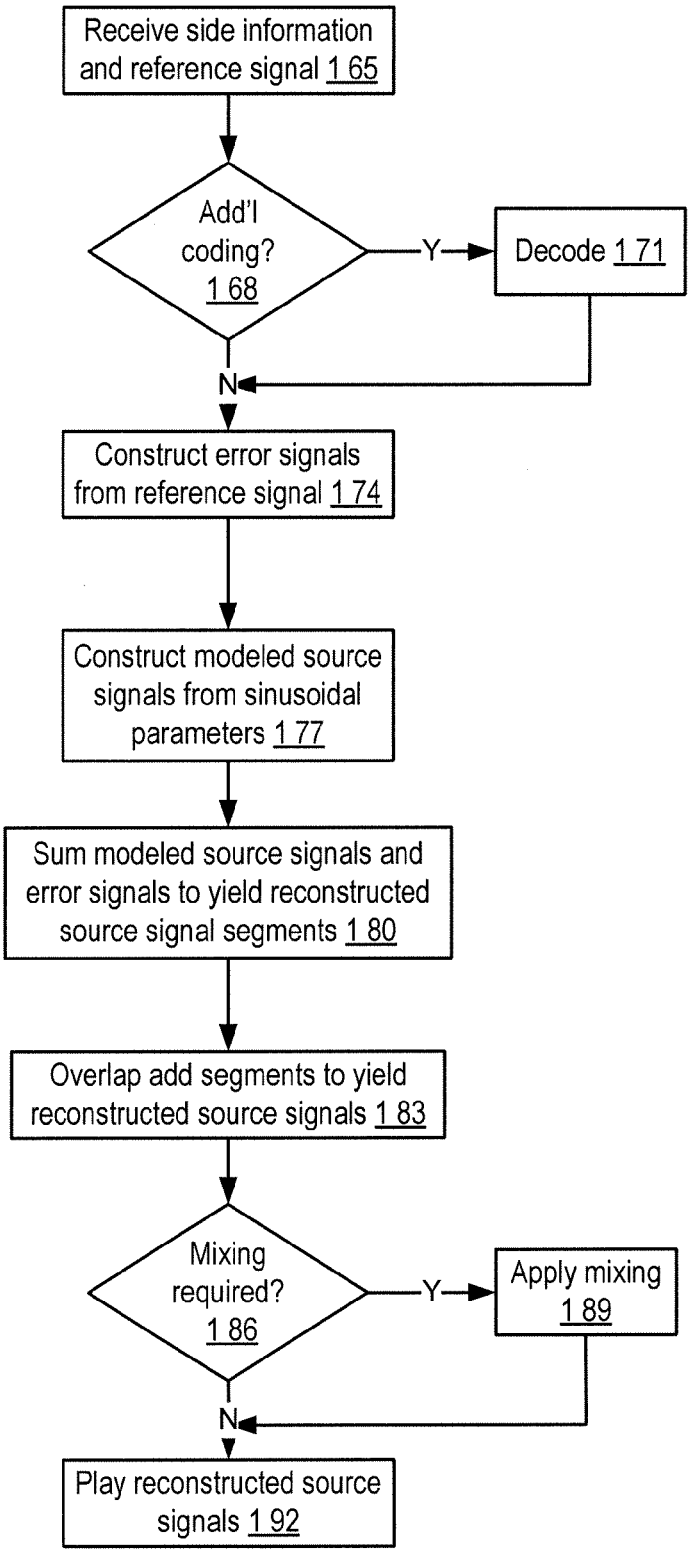

Additional features associated with the APT are illustrated by way of the following examples and/or illustrations:

FIGS. 1A-1B show implementations of logic flow for encoding and decoding of audio signals in accordance with on embodiment of APT operation. The APT receives M audio source signals at 101 to encode and/or compress for efficient storage, transmission, and/or the like. In an implementation, the source signals are monophonic audio recordings—the APT may not necessarily retain the relative spatial audio image of the available recordings. Accordingly, after decoding, these signals may not necessarily be correctly rendered (i.e., retain the correct spatial audio image) through a stereophonic or multichannel audio rendering system unless a mixing process is applied following the decoding.

These signals can be configured as a wide variety of audio signals including separate instrument recordings from a studio recording of an ensemble, spot signals from a concert hall performance recording, speech signals recorded for teleconferencing or presentation purposes or other types of signals. In APT implementations configured for stereophonic and multichannel audio applications, these signals are the signals before the mixing process is applied for obtaining the final multichannel audio recording. In other words, these are the signals that are used by the audio engineers in order to produce the final multi-channel recording under a mixing process. These are often recorded in multi-track recordings by the audio recording industry, and usually contain the separate recording of each instrument, singing voice, and/or the like in an ensemble, possibly with some interference from the other instruments in the background.

The importance of encoding, and thus having available at the decoder, the multiple audio source signals of a music recording instead of the final mixed multichannel audio recording is due to the offered interactivity. Interactive applications that are of immense interest for multichannel and immersive audio environments, such as remote mixing of the multichannel recording and remote collaboration of geographically distributed musicians, can be accomplished only when the APT decoder has access to the microphone signals and locally creates the final mix. For these applications, the number of multiple audio channels to be encoded is much higher than in multichannel recordings, and low bit-rate encoding of each channel is critical. It is also important to mention other applications of the APT such as teleconferencing. In this case, if the separate speech recordings of multiple speakers are available at the APT decoder side, the APT may be configured to attenuate or even mute the recording of one or more speakers at each conference site (decoder).

Each audio source signal my be segmented into a plurality of audio source signal segments at 105. In one implementation, each segment may comprise a short time-frame portion of the original audio source signal, such as on the order of 20 milliseconds long. Segments may be mutually exclusive or may be allowed to overlap.

In an implementation of the APT, the APT may be configured to apply a sinusoid plus noise model (for brevity mentioned as SNM henceforth) to address issues related to coding multiple audio source signals. Previous attempts to use SNM models resulted in degraded audio quality in the decoded signals. This is because to the sinusoidal error signal has been modeled using coarse methods which failed to retain the needed information for high-quality audio re-synthesis. Implementations of the APT are configured for applying SNM models to multiple audio source signals for achieving high degree of information reduction, without a significant degree audible degradation in the recording. Implementations of the APT achieve high quality audio by processing the audio to render the signals simultaneously, e.g., such as in a multichannel audio recording or a teleconferencing presentation containing multiple speakers.

Accordingly, at 110, the APT may model source signal segments, such as by means of a sinusoidal model to extract sinusoidal parameters. Depending on the implementation, the sinusoidal model employed may be based on a variety of models that achieve the functionality described herein. Each audio segment may, for example, be modeled as a summation of a few sinusoids, each of different frequency, phase, and amplitude (collectively mentioned as sinusoidal parameters). The sinusoidal parameters can be constant per audio segment but can even be time-varying. Depending on the implementation, the APT may implement any of a variety of sinusoidal models and can encode the audio source signals with high quality through either hardware, software or a combination of hardware and software solutions.

The APT may subsequently calculate a difference between the sinusoidal signal and the original audio signal in each time segment, effectively yielding a remainder signal termed the sinusoidal noise component or error signal 115. After the sinusoidal parameters for each audio segment of a particular audio source signal are estimated and the sinusoidal error signal is obtained, the next step is to extract the spectral envelope of the sinusoidal error signal 120. The envelope extraction can be accomplished by a variety of different methods, such as via Linear Prediction Coefficients (LPC). In an implementation of the APT, a spectral envelope model may be based on performing sub-band analysis of the sinusoidal error signal and applying a different LPC model for each sub-band. In an implementation, the APT may be configured with Octave-spaced sub-bands. In implementations of the APT that use only one sub-band, a basic LPC model is achieved. After the spectral envelope of the sinusoidal error is obtained, the envelope is extracted from the sinusoidal error (e.g., by inverse filtering methods), leaving a signal which is termed as the residual signal 120. Thus, the residual signal may be determined as the signal that remains from the original audio source signal when the sinusoidal parameters are extracted, followed by extraction of the spectral envelope parameters from the sinusoidal error signal.

For each audio source signal, the APT is configured to obtain for each short-time segment the sinusoidal parameters and the sinusoidal noise spectral envelope (along with the corresponding power), which form the side information per audio source signal. This information is time-varying, since these parameters differ from segment to segment. Based on the above description, the residual signal for each audio source signal is obtained in short-time segments. A determination may be made at 125 as to whether the multiple residual signal segments should be processed separately or combined in a segment sum to yield one residual signal per each of the original audio source signals. If a segment sum is desired, then the residual signal segments may be overlap-added to yield a longer residual signal 130. In either case, the residual signals and/or residual signal segments for all audio source signals are summed to yield a reference signal. A determination may be made at 135 as to whether or not to employ a weighted sum of residual signals in the creation of the reference signal. If a weighted sum is desired, then a weighting schedule may be applied 140, the schedule specifying the relative contributions of residual signals and/or residual signal segments corresponding to each audio source signal to the final reference signal. In one implementation, the weights themselves may be segment-dependent and/or otherwise time varying. The residual signals and/or residual signal segments, possibly including weighting factors, may be subsequently summed at 145 to yield the reference signal.

A determination may be made at 150 as to whether any additional encoding of the heretofore encoded audio information is desired. If such encoding is desired, it is applied to the side information (i.e., sinusoidal parameters and/or spectral envelope information) and/or to the reference signal at 155. Such coding may comprise any of a variety of audio and/or data encoding methods and/or protocols, such as MP3 encoding, AAC, Dolby, AC-3, and/or the like. Finally, the side information, comprising the sinusoidal parameters and spectral envelope, and the reference signal may be packaged as a data structure for subsequent use, storage, transmission, and/or the like 160.

FIG. 1B shows an implementation of logic flow for decoding of APT encoded audio signal data in one embodiment of APT operation. Side information and reference signal are received for decoding at 165, such as via a communications network, queried from a database, and/or the like. A determination may be made at 168 as to whether any special or additional encoding has been applied to components of the side information and/or the reference signal in addition to APT encoding. If so, a decoding process corresponding to that special or additional encoding may be applied to encoded components 171. The APT may subsequently construct sinusoidal error signals corresponding to each of the original audio source signals using the reference signal and the spectral envelope associated with each source signal 174. The spectral envelope may be used to filter the corresponding time segments of the reference signal and, thus, yield a sinusoidal error signal. Details of sinusoidal error signal reconstruction are provided below. The APT may also construct modeled source signals for each original audio source signal using a sinusoidal model in conjunction with sinusoidal parameters associated with each original source signal 177. For example, a modeled source signal may comprise a sum of sinusoids wherein the amplitudes, frequencies, phases, and/or the like of contributing sinusoids are embodied in the sinusoidal parameters component of the side information. Once a sinusoidal error signal and modeled source signal are reconstructed for each audio source signal, they may be summed to approximate the original audio source signal, thus effectively decoding the audio source signal content from the encoded information 180. Decoding may be performed on a segment-by-segment basis, whereby audio source signals are reconstructed one segment at a time. In this case, the result of reconstruction may be a plurality of audio source signal segments that may then be overlap-added to yield the full audio source signals 183. Once the original M audio source signals are reconstructed, a determination may be made as to whether any mixing is required prior to playback 186. If required, mixing may be performed at 189 to adjust the relative contributions and/or amplitudes of individual monophonic audio signals to the final mix. Finally, the reconstructed source signals may be played back, alone, in combination, in the context of a mix, and/or the like, at 192.

In an implementation, the APT may be configured with five system components. During the analysis stage, the APT may perform the following for each short-time segment of each audio source signal:

(i) an extraction of the sinusoidal parameters component, using a selected implementation of the sinusoidal model, (ii) a derivation of the sinusoidal error signal component, (iii) an extraction of the spectral envelope parameters of the sinusoidal error signal component (possibly using a sub-band-based model), (iv) a derivation of the residual signal component, and (v) a summation of all the residual signals for deriving the reference signal component.

Figure 2A:
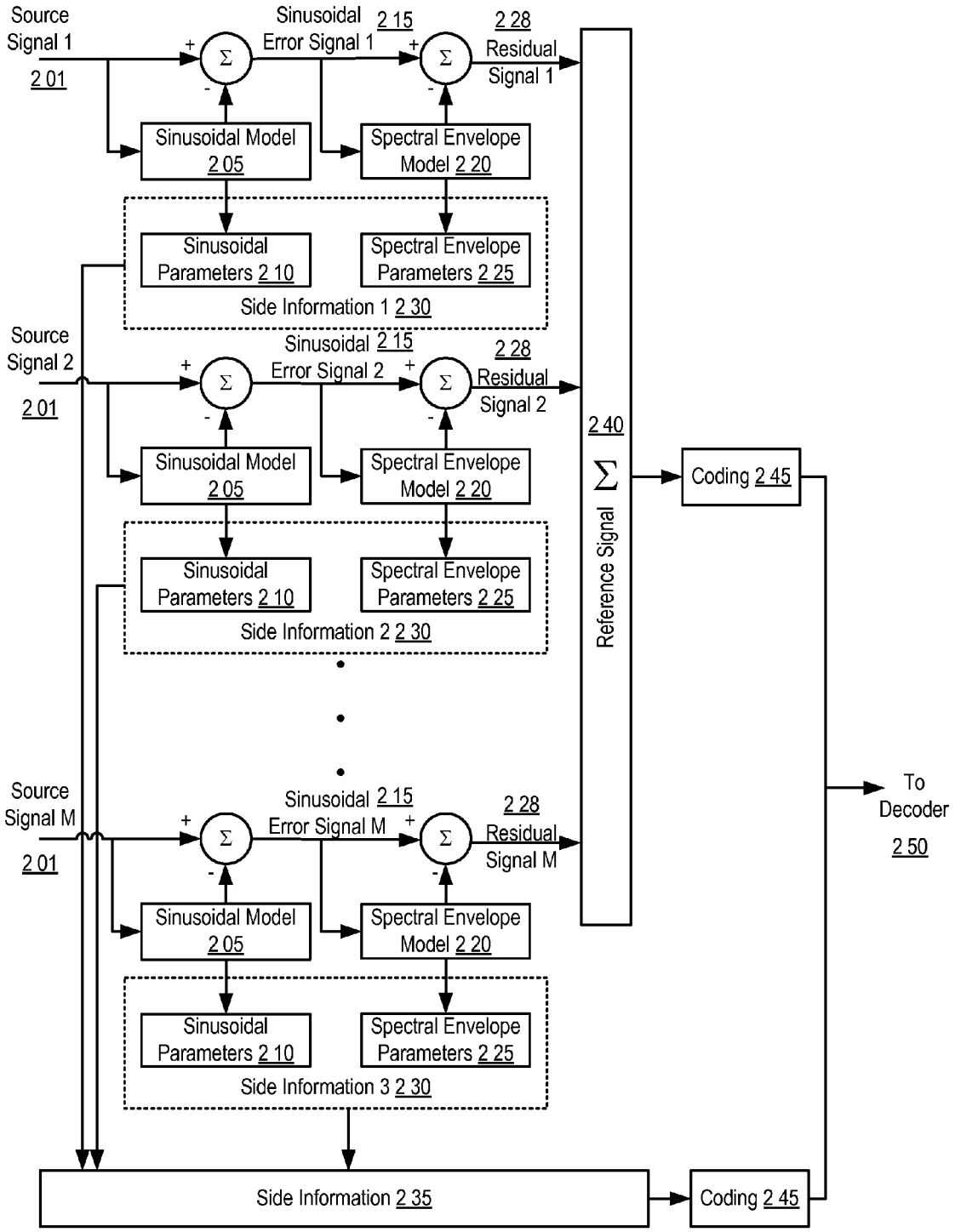
FIGS. 2A-2B show an implementation of combined logic and data flow pertaining to schematic APT components in one embodiment of APT operation.
Figure 2B:
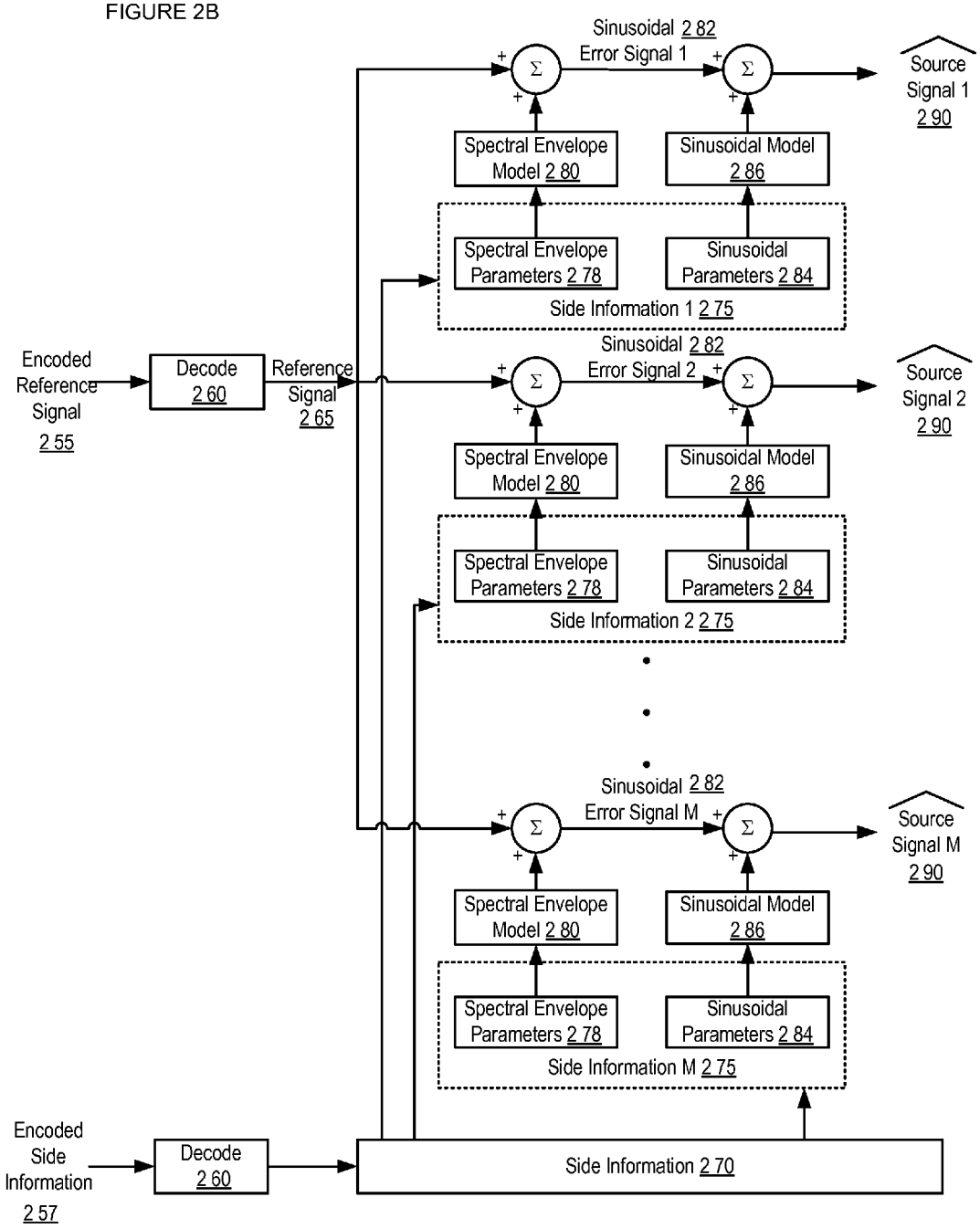

FIGS. 2A-2B show an implementation of combined logic and data flow pertaining to schematic APT components in one embodiment of APT operation. Component features implementing for processing a plurality of audio source signals (source signal 1, source signal 2, . . . , source signal M) 201 in accordance with APT functionality are described in detail below.

APT Sinusoidal Extraction Components

The sinusoidal model 205 may represent a harmonic signal s(n), n being the time index, as a sum of a small number of sinusoids with time-varying amplitudes and frequencies:

$$s(n) = \sum_{l=1}^{L} A_l(n)\cos(\theta_l(n)), \tag{1}$$

where $A_l(n)$ and $\theta_l(n)$ are the instantaneous amplitude and phase, respectively. To find the parameters of the model 210 associated with a given audio source signal 201, the extraction component segments the source signal into a number of short-time frames and determines the short-time Fourier transform (STFT) for each frame. The extraction component may then identify the prominent spectral peaks from the resulting power spectrum, such as by using a peak detection algorithm. Each peak may be associated to a triad of the form $(A^q_l, \omega^q_l, \phi^q_l)$ (amplitude, frequency, and phase), which corresponds to the lth sinewave component of the qth time segment or frame. A peak continuation algorithm may be employed in order to assign each peak to a frequency trajectory by matching the peaks of the previous frame to the current frame, using linear amplitude interpolation and/or cubic phase interpolation. However, any algorithm which retains a small number of frequency components out of the actual spectrum of a harmonic (e.g. audio or speech) signal at each short-time segment, based on the perceptual importance of those frequency components, can be classified as a sinusoidal model 205.

The APT may implement any of a number of variations of the sinusoid plus noise model for applications such as signal modification and low bit-rate coding, focusing on three different problems: (1) accurately estimating the sinusoidal parameters 210 from the original spectrum, (2) representing the modeling error (noise component) 215, and (3) representing signal transients. While some noise modeling methods offer the advantage of low bit-rate coding for the noise part, the resulting audio quality may often be worse than the quality of the original audio signal (subjective results with average grades around 3.0 in a 5-grade scale have been reported).

In contrast, the APT achieves high quality audio modeling (achieving a grade around 4.0 is desirable). An implementation of the APT achieves high quality audio compared, not only to the sinusoids-only model but also compared to the original recording. The APT facilitates implementing a low number of sinusoids (e.g., even 5-10 sinusoids per audio segment) for high-quality audio coding, which may be substantially beneficial for low bit-rate applications.

The APT may obtain sound representation by restricting the sinusoids to modeling only the deterministic part of the sound, leaving the rest of the spectral information in the noise component e(n). For example, each short-time segment s(n) can be represented as:

$$s(n) = \sum_{l=1}^{L} A_l(n)\cos(\theta_l(n)) + e(n). \tag{2}$$

After the sinusoidal parameters 210 are estimated, the noise component 215 may be computed by subtracting the harmonic component from the original signal, i.e:

$$e(n) = s(n) - \sum_{l=1}^{L} A_l(n)\cos(\theta_l(n)). \tag{3}$$

APT Spectral Extraction Components

To extract spectral envelope parameters 225 associated with a sinusoidal noise and/or error signal 215, the APT may implement a spectral envelope model 220 such as, for example, a Linear Predictive (LP) analysis, to estimate the spectral envelope of the sinusoidal noise 215. However, the APT may use any other parametric method or model 220 for estimating the spectral envelope 225 of a signal. In an example implementation of the LPC model 220, the APT may use the following Auto-Regressive (AR) equation for the noise component 215 of the sinusoidal model for a particular time-segment.

$$e(n) = \sum_{i=1}^{p} \alpha(i)e(n-i) + \sigma_e^2 r_e(n). \tag{4}$$

In an implementation of the APT, Linear Predictive (LP) analysis is applied to estimate the spectral envelope 225. The quantity e(n) is the sinusoidal noise component 215, while $r_e(n)$ is the residual of the noise 228, p is the AR filter order, and $\sigma^2_e$ is the power of e at the particular time segment. The $(p+1)^{th}$-dimensional vector $\vec{\alpha}$, where:

$$\vec{\alpha} = [1, -\alpha_1, -\alpha_2, \ldots, -\alpha_p]^T \tag{5}$$

$\vec{\alpha}$ represents the spectral envelope of the noise component e(n) (symbol T in equation (5) denotes transposition). In the frequency domain (4) becomes $$S_e(\omega) = \left|\frac{\sigma_e}{F_\alpha(\omega)}\right|^2 S_{r_e}(\omega), \tag{6}$$

where w is the frequency index, $S_e(w)$ and $S_{re}(w)$ are the power spectra of e(n) and $r_e(n)$, respectively, and $F_\alpha(w)$ is the frequency response of the LP filter $\vec{\alpha}$.

Since in this description there are two noise quantities introduced, i.e., the sinusoidal model noise e and its whitened version $r_e$, we will refer to e as the (sinusoidal) noise signal or sinusoidal error signal 215 and to $r_e$ as the residual (noise) signal of e 228. The (p+1) LPC coefficients included in vector $\vec{\alpha}$, the corresponding power $\sigma^2_e$ related to the spectral envelope, and the L sinusoidal parameters (triad) for the corresponding audio segment together form the side information 230 (per audio source signal) in an implementation of the APT.

It should be noted that the sinusoidal parameters 210, and the noise spectral envelopes and noise power 225, can be quantized using a variety of methods derived for such parameters. This includes any related transformations of these parameters for improved encoding performance, e.g. the Line Spectral Frequencies (LSFs).

Although the APT may implement any of a number of spectral envelope estimation models 220, an example implementing multiband LPC estimation procedure for the estimation of the sinusoidal error spectral envelope will be discussed herein.

The LPC model is very useful in speech synthesis and transformations, but is not as efficient for audio signals. The APT derives an AR-based model which can be successfully applied to audio signals based on multi-resolution analysis. It is of interest to explain the reasons why an accurate spectral envelope estimation procedure may be important for the resulting audio quality of the proposed APT. One aspect of the APT system is the use of the reference signal for extracting all audio source signals at the decoder. Such re-synthesis is particularly accurate when the perceptually important information per audio source signal is retained in the side information 235 (the sinusoidal parameters 210 and the spectral envelope parameters and corresponding noise power 225) by the APT. On the other hand, it may be desirable for the side information 235 to contain the least possible information to facilitate low bit-rate applications. Thus, given the sinusoidal parameters 210, the spectral envelope estimation may be used for deriving important information of the sinusoidal error signal with only a small number of parameters per audio segment. This may be achieved by the APT by the use of the multiband LPC model 220. The APT divides the spectrum of each of the sinusoidal error signals into frequency bands, and LPC analysis is applied in each band separately (sub-band signals may possibly be down-sampled).

The APT implementing a small LPC filter order for each band results in much better estimation of the spectral envelope than a high-order filter for the full frequency band. Thus, the APT component described above with regard to equation (4) for the extraction of the spectral envelope from the sinusoidal error signals can be performed separately in each sub-band. The number of bands and type of sub-band analysis may vary based on the APT implementation, however a possible implementation discussed herein employs octave sub-band analysis. Implementations of the APT configured with 8 octave bands facilitate most applications (possibly fewer bands for speech-only applications). The special case of the APT using only one band is another possibility included in the above description and corresponds with a full-band LPC analysis.

APT Reference Signal Extraction Components

In an implementation of the APT configured to encode a collection of M multiple audio source signals 201, the side information 235 is extracted for each audio source signal and a corresponding residual signal $r_{e(k)}$, k=1 . . . M 228 is obtained (k is the index of the corresponding audio source signal). The reference signal for the collection of audio source signals $x_{(ref)}$ 240 may be obtained by summation of the M residual signals, i.e.,:

$$x_{(ref)} = \sum_{k=1}^{M} r_{e(k)} \tag{7}$$

Thus, in one implementation, summation of the residual signals forms the reference signal. This summation may, in some implementations, be configured as a weighted summation, using different weights, possibly even time-varying, for the residual of each audio source signal. The summation may, in one implementation, be performed on a segment-by-segment basis or, in an alternative implementation, after longer (in time) residual signals are obtained (per each audio source signal) by overlap-addition of the segments.

In one implementation, the reference signal and/or side information may subsequently be coded using any method for monophonic audio coding, such as MP3 audio coding 245. Once prepared, the reference signal and side information may be packaged as a data structure, stored in a database, transmitted to a remote receiver for subsequent decoding 250, and/or the like.

APT Source Audio Reconstruction Components

For re-synthesis of the source audio signals, the APT may be configured to reconstruct each audio source signal using its sinusoidal components and its noise spectral envelopes; sinusoidal components may be added to the noise component, obtained by filtering the reference signal with the noise spectral envelopes corresponding to each audio source signal. As the harmonics may capture most of the important information for each microphone signal and the LP coefficients capture most of the audio source signal-specific noise characteristics, the residual noise part that remains may be similar for all the microphone signals. By taking the reference signal and filtering it with the correct noise envelope (the spectral envelope corresponding to audio source signal k), the APT determines a noise signal with very similar spectral properties to the initial noise component of the audio source signal k. The filtered reference signal may then be summed with the sinusoidal components configured with appropriate sinusoidal parameters to approximate the original audio source signals encoded by the APT.

FIG. 2B shows an implementation of combined logic and data flow pertaining to APT components for decoding encoded audio signal components (257, 255) in one embodiment of APT operation. To formalize the previous discussion, considering a collection of M audio source signals, the APT may implement a decoding process 260 to undo any additional encoding (e.g., MP3 encoding, and/or the like) applied to components of the encoded side information 257 and/or the encoded reference signal 255. The reference signal 265 may then be processed in accordance with a spectral envelope model 280 incorporating spectral envelope parameters 278 associated with each original audio source signal to yield a corresponding sinusoidal error signal 282. Specifically, the sinusoidal error signal for audio signal k, $e_k(n)$, 282 may be represented in the frequency domain (power spectrum) as:

$$\hat{S}_{e_k}(\omega) = \left|\frac{\sigma_{x_k}}{F_{\alpha_k}(\omega)}\right|^2 S_{x(ref)}(\omega), \tag{9}$$

where $F_{\alpha k}(\omega)$ is the frequency response of the signal's LP noise shaping spectral envelope filter $\vec{\alpha}_k$ (i.e. the p+1-coefficient vector containing the a(i) coefficients in (5) for the $k^{th}$ audio source signal), $\vec{\sigma}_{x_k}{}^2$ is the noise power, and $\hat{e}_k(n)$ is the estimated sinusoidal noise component 282. Also, $S_{x(ref)}(\omega)$ is the power spectrum of the reference signal $x_{(ref)}$ 265.

The APT may then apply a general relation for the re-synthesis of one of the audio source signals $\hat{x}_k$ 290 (a decoded version of the originally available $x_k$, which may possibly differ from the original audio source signal by a coding error) using the sinusoidal error, $e_k(n)$ 265, and the extracted side information 270 for audio source signal $x_k$ 275. Specifically, the sinusoidal parameters 284 are employed within an applicable sinusoidal model 286, such as a sum of sinusoids, to yield a harmonic component of the reconstructed audio source signal 290 that may be added to the sinusoidal error component as follows:

$$\hat{x}_k(n) = \sum_{l=1}^{L} A_{k,l}(n)\cos(\theta_{k,l}(n)) + \hat{e}_k(n),\ k = 1, \ldots, M, \tag{8}$$

where $A_{k,l}(t)$ and $\theta_{k,l}(t)$ represent the sinusoidal parameters 284 of the microphone signal k, and $\hat{x}_k(n)$ represents the reconstructed audio source signal output 290. In one implementation, the above procedure may be performed on a segment-by-segment basis and the audio source signals at the decoder 290 obtained by overlap-addition. The side information 270 and the reference signal 265 at the APT decoder may contain a coding error and thus may differ from the corresponding signals that were encoded at the APT encoder. However, with a proper encoding procedure, such error may not significantly degrade the resulting audio quality of the reconstructed audio source signals.

Alternative APT encoding/decoding component implementations are possible with similarities to the above analysis. In one implementation, the reference signal may be derived by adding the original audio source signals instead of the corresponding residual signals at the APT encoder. The remaining APT encoding components will remain substantially the same. In this implementation, the APT decoder will then derive the reference residual signal from the reference signal. This reference residual may subsequently be used in the same manner that the reference signal was used in the previous description of the APT, discussed above. In order to derive the reference residual from the reference signal the APT may process each audio segment in the following manner. The sinusoidal components from all the audio source signals may be subtracted from the reference signal. An envelope extraction method may then be applied to the resulting sinusoidal error signal (e.g., using LPC analysis, possibly in sub-bands). Finally, the reference residual may be extracted from the sinusoidal error signal by extracting its envelope (e.g., by inverse filtering). The resulting reference residual signal can be used as explained in the description of the APT given in the previous sections.

Various implementations of the APT achieve excellent audio quality when all audio source signals are rendered simultaneously, regardless of whether they are mixed before rendering or remain unmixed. In some implementations, the side information for each audio source signal can be encoded with a typical rate of 10 Kbit/sec, for high audio quality.

FIGS. 3A-3I show example signals of an implementation of a sinusoidal coding process in one embodiment of APT operation. The coding process may, in one implementation, apply mathematical analysis, such as Fourier transforms and/or the like, to convert signal data from the time-domain, in which the amplitude of the signal is shown at various times, to the frequency-domain, in which the amplitude of the signal is shown at different frequencies and/or frequency components. Conversion of audio signals between time-domain and frequency-domain representations may assist in the comparison of those signals with one or more sinusoidal models, as described below.

Figure 3A:
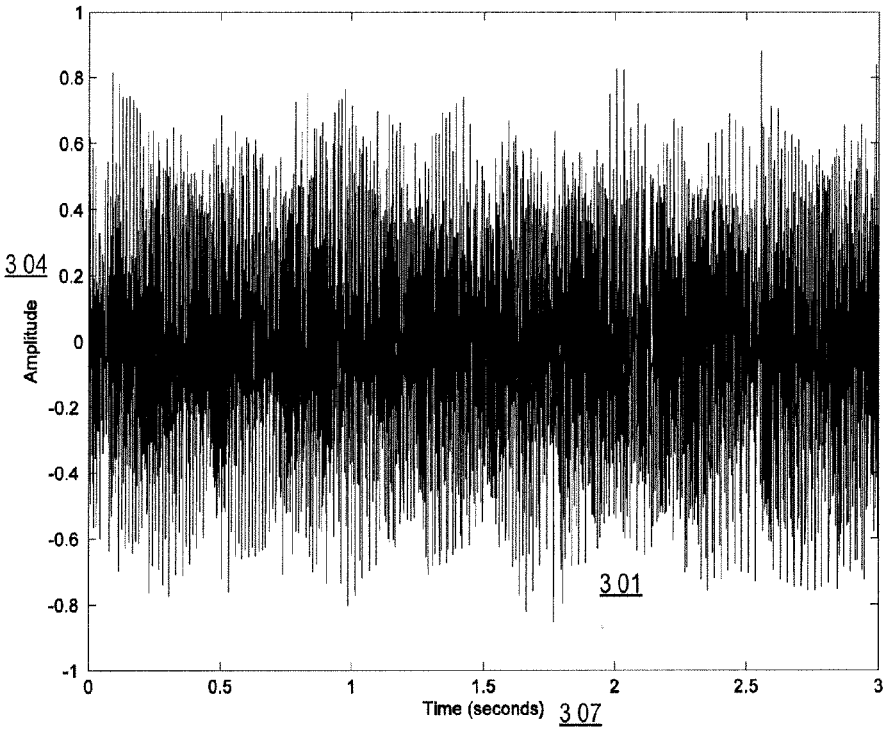
FIGS. 3A-3I show example signals of an implementation of a sinusoidal coding process in one embodiment of APT operation.
Figure 3B:
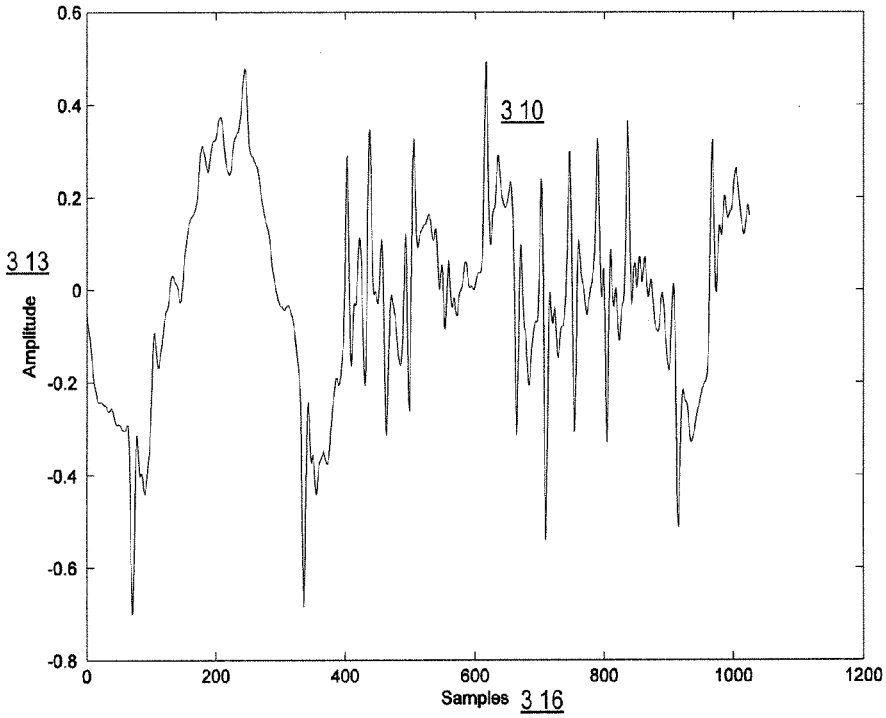
Figure 3C:
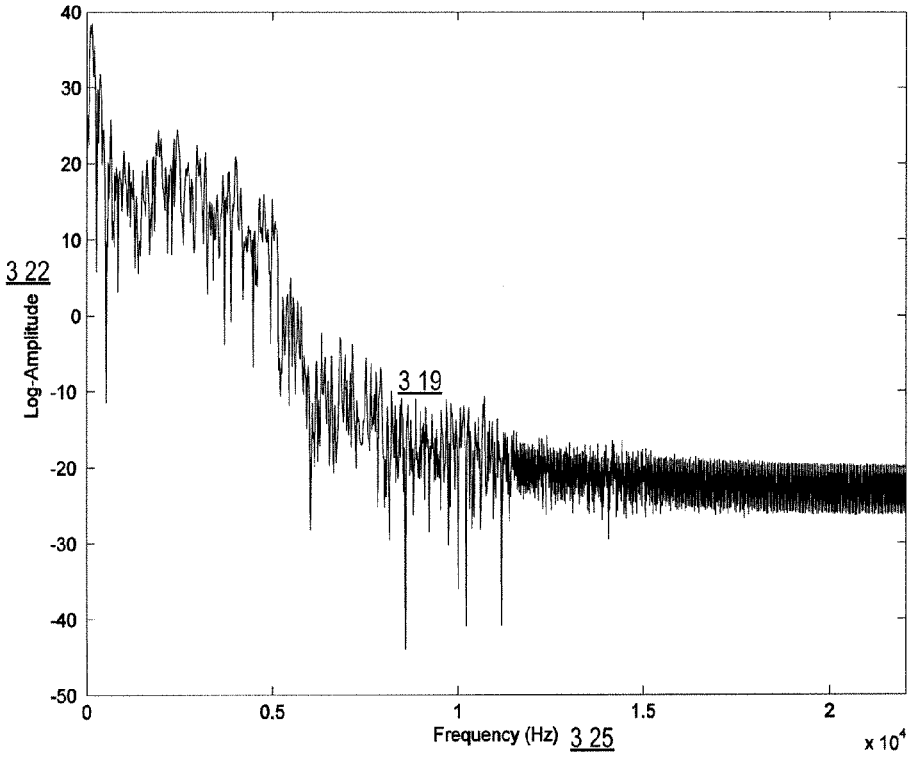
Figure 3D:
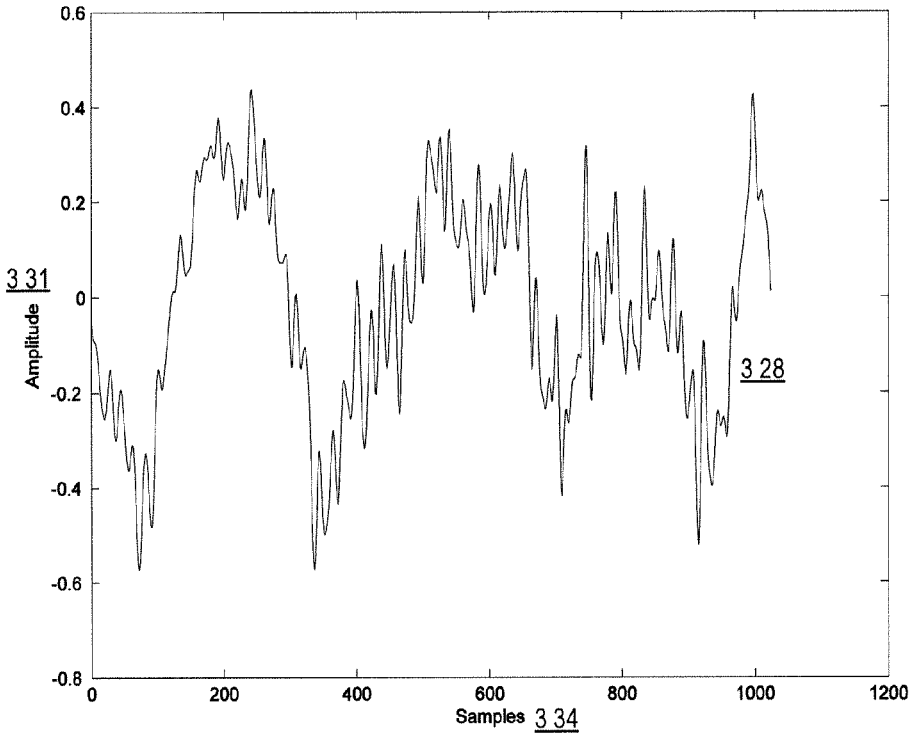
Figure 3E:
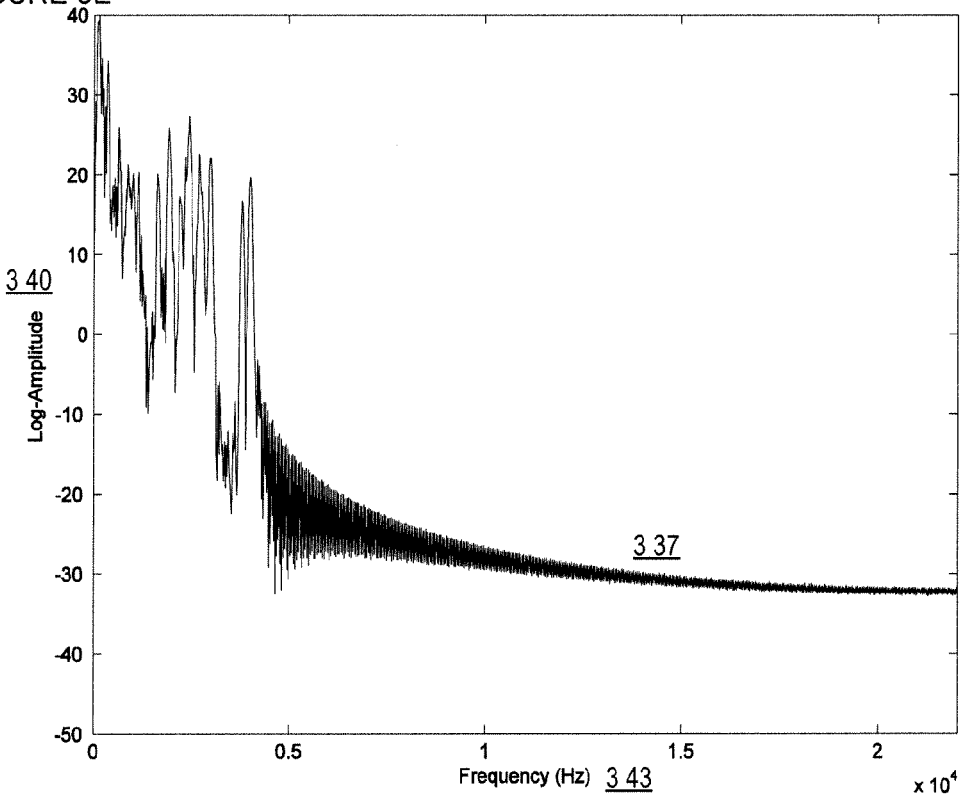

In FIG. 3A, an example signal 301 is shown on a plot of amplitude 304 versus time 307. The displayed signal represents a three second recording of an electric guitar, sampled at a rate of 44100 Hz. In FIG. 3B, the signal 310 plotted as amplitude 313 versus samples 316 represents a randomly selected segment (1024 samples) of the guitar signal recording shown in FIG. 3A. The signal 319 shown in FIG. 3C, plotted as the logarithm of the amplitude 322 versus frequency 325, comprises the Fourier transform (i.e., frequency-domain representation) of the signal 310 from FIG. 3B. In FIG. 3D, the signal 328 represents the modeled (sinusoidal) representation of the 1024 sample time-domain signal 310 shown in FIG. 3B, plotted as amplitude 331 versus sample 334. The frequency-domain representation of the modeled signal 328 is shown at 337 in FIG. 3E, plotted as the logarithm of amplitude 340 versus frequency 343. Comparison of the frequency-domain signals in FIG. 3C (319) and FIG. 3E (337) reveal clear differences, and thus the sound associated with the sinusoidal representation 337 is different and/or artificial in comparison to the original signal 319.

Figure 3F:
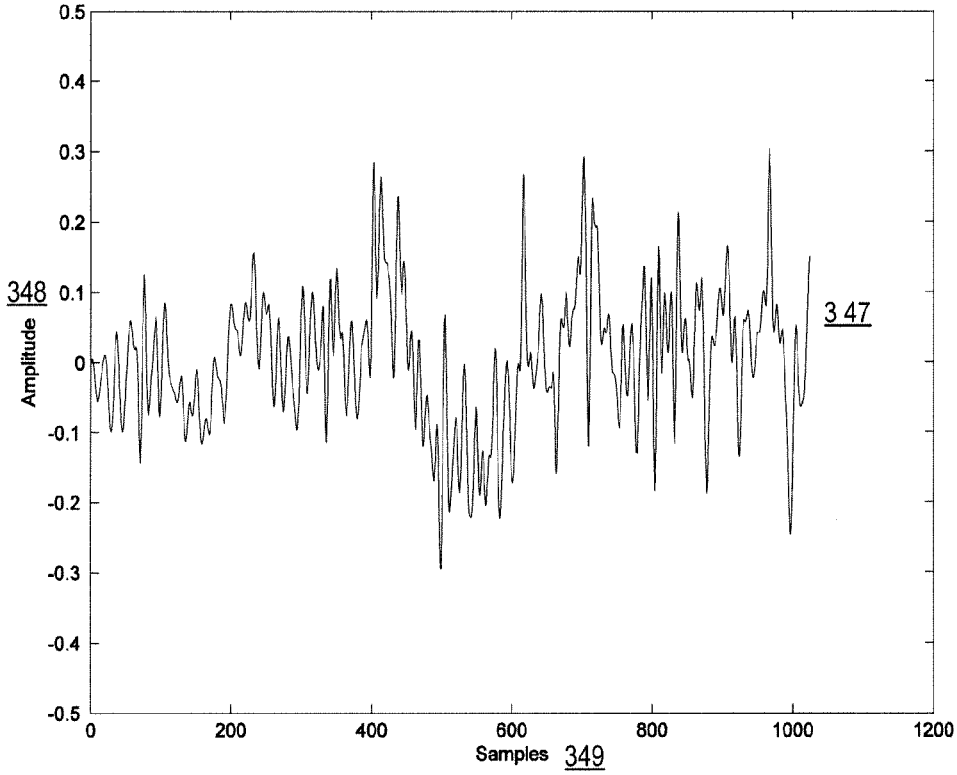
Figure 3G:
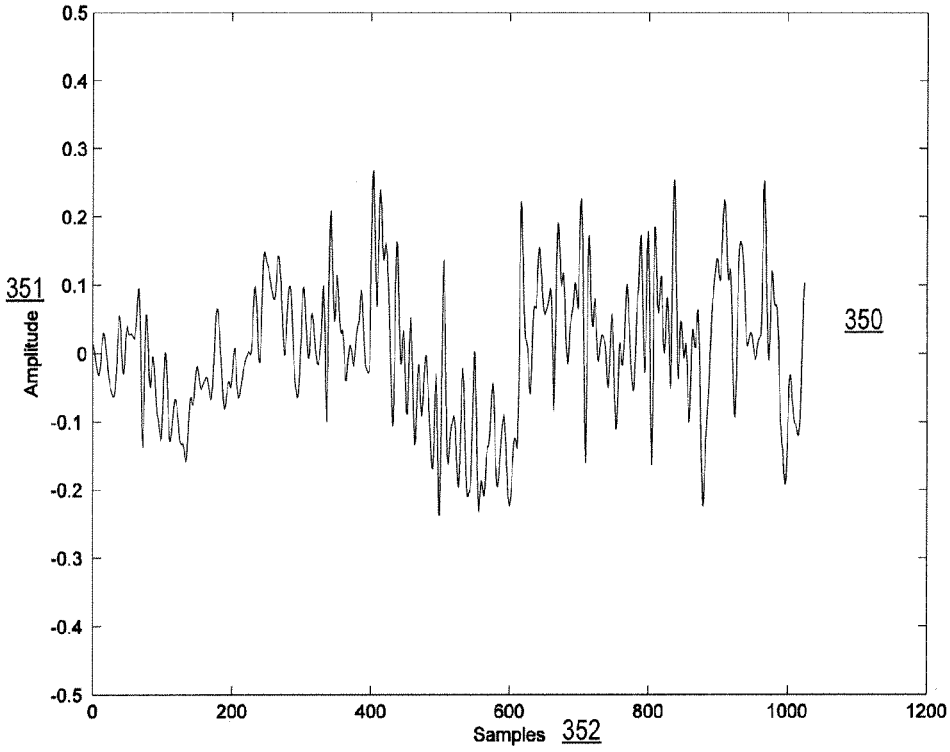
Figure 3H:
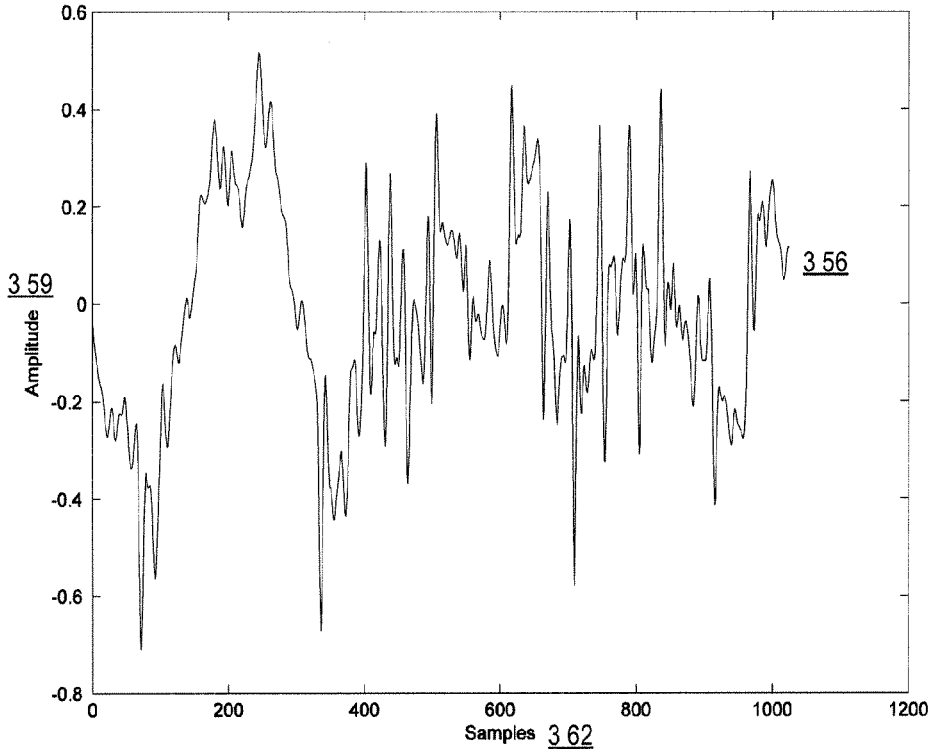
Figure 3I:
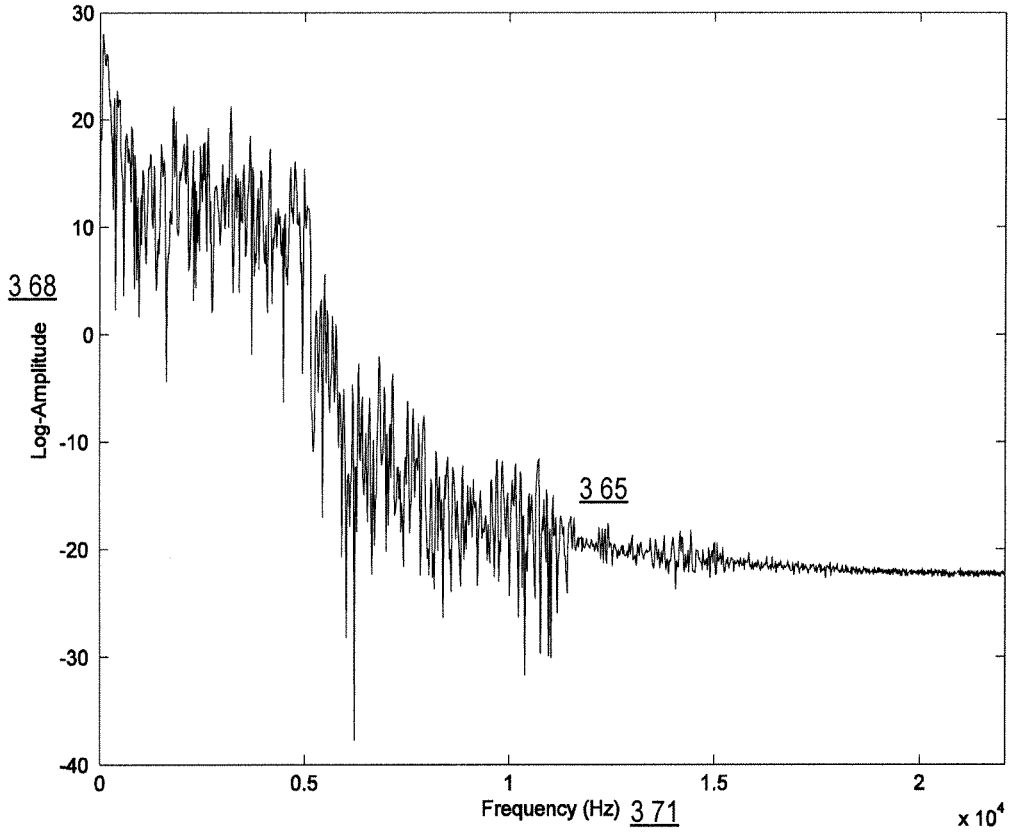

FIG. 3F shows a signal 347, plotted as amplitude 348 versus samples 349, representing the sinusoidal error signal resulting from the difference between the original 1024 sample signal 310 in FIG. 3B and the sinusoidal representation signal 328 in FIG. 3D. FIG. 3G shows an implementation of a re-synthesized sinusoidal error signal 350, plotted as amplitude 351 versus samples 352, as generated by the APT in one embodiment of APT operation. Similarities between the re-synthesized error signal 350 and the original error signal 347 are evident. The re-synthesized time-domain segment signal 356 shown in FIG. 3H as amplitude 359 versus samples 362, has been generated based in part on the re-synthesized error signal 350 from FIG. 3G. This re-synthesized segment signal 356 appears to be closer to the original segment signal 310 in FIG. 3B than the sinusoidal representation of the segment signal 328 in FIG. 3D. Similarly, the frequency-domain version of the re-synthesized segment signal shown at 365 in FIG. 3I, plotted as the logarithm of amplitude 368 versus frequency 371, is closer to the Fourier transform of the original segment signal shown at 319 of FIG. 3C than the frequency-domain version of the sinusoidal representation shown at 337 in FIG. 3E. Accordingly, the sound associated with the signals in FIG. 3H and/or FIG. 3I is closer to the original recording.

In some implementations of the APT, a sinusoids plus noise model and a sub-band based spectral envelope estimation procedure may be applied to audio source signals, with the objective of low bit-rate coding by use of a reference audio signal. By focusing on the audio source signals instead of the mixed audio signals, the APT may be implemented within interactive multichannel audio applications and teleconferencing systems/applications.

Figure 4:
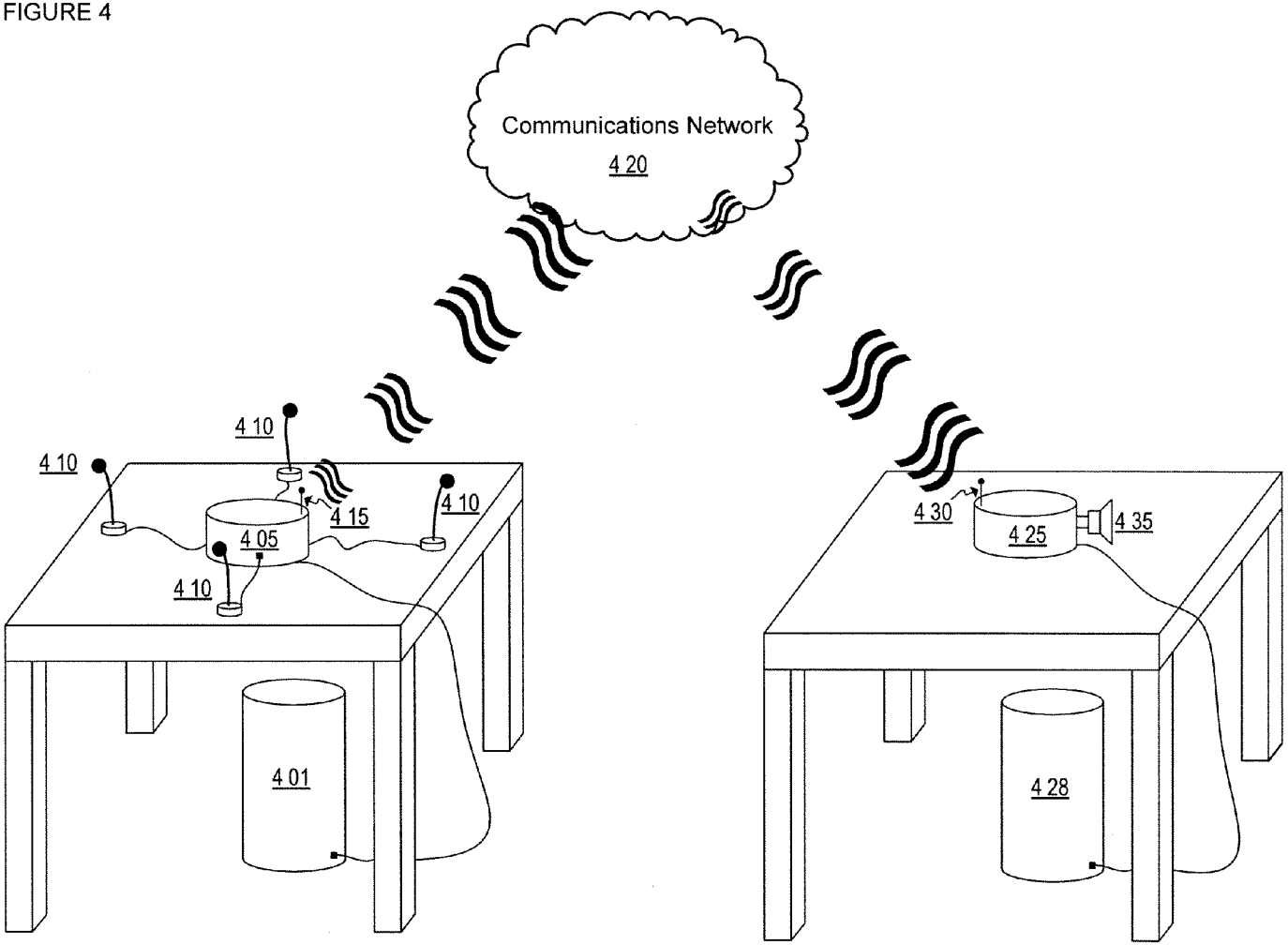
FIG. 4 shows an illustration of one implementation of a teleconferencing application in one embodiment of APT operation.

FIG. 4 shows an illustration of one implementation of an example teleconferencing application in one embodiment of APT operation. An APT system 401 (aspects of an example APT system are discussed in greater detail below in FIG. 6) at a first location may be communicatively coupled to an audio acquisition and/or recording module 405, configurable to receive, record, store and/or the like audio information, such as from one or more microphones, telephone receivers, and/or other audio sensors, transducers, and/or the like 410. The received audio signals may be processed by the APT system 401 in accordance with the methods described herein, possibly with additional encoding, compression, and/or the like as needed or desired within a given implementation. The resulting monophonic reference signal along with corresponding side information, may then be transmitted via a transmitter 415, to a receiver 430 at a second site by means of a communications network 420. An APT system 428 at the receiving location may reconstruct the original audio signals from the reference signal and side information. The receiving APT system may be coupled to a module 425 configured to playback the reconstructed audio signals, such as via an integrated speaker 435.

Though the implementation illustrated in FIG. 4 shows a single first location from which the audio signals are acquired and a single second location to which the processed signals are sent, it is to be understood that a variety of other configurations are possible within various embodiments of APT operation. For example, in one implementation, one or more audio source locations may be coupled to one or more audio destination locations. Furthermore, a single location may serve both as a source of audio information as well as a destination for processed audio signals acquired at other locations. Such a configuration may be common to several teleconferencing applications, wherein APT systems at various locations may be configured both to record/process audio from the teleconference participants at each location and to decode/playback audio received from other locations. It should further be noted that, though the implementation of a teleconferencing application illustrated in FIG. 4 employs a wireless communications network, any of a variety of other communications methods and/or conduits may be employed within various embodiments of APT operation.

To further illustrate an APT teleconferencing application in one embodiment, a description of a specific, three-site teleconferencing example is provided. The three sites may comprise New York, USA (Site 1): Athens, Greece (Site 2); and Shanghai, China (Site 3). Three people participate at Site 1, five at Site 2, and four at Site 3. In order for all the participants to communicate as if they were in the same office space, the speech signals from all twelve participants may be made available to all three sites in real time. Encoding the twelve speech signals separately and transmitting them to two different sites, so that all speech signals are available at each site, may require significant data acquisition, processing, and/or transmission rates to facilitate an effective teleconference. Even if each speech signal were compressed before transmission as a monophonic signal, such a technique may still require a transmission rate of 12 signals×2 locations×64 kbit/sec=1536 kbit/sec.

On the other hand, APT processing may allow only one monophonic signal per site to be transmitted, along with corresponding side information per speech signal (which, in one implementation, may be on the order of 20 kbit/sec). Accordingly, the transmission rate for APT processed signals may be approximately 12 signals×2 locations×20 kbit/sec (for the side information)+3 signals×2 locations×64 kbit/sec (for the reference signals)=864 kbit/sec. This is close to half the rate in the individual compression scheme. The APT may further allow each speech recording to be individually decoded and reproduced at the receiver, unaffected by the presence of the remaining recordings. This may be useful, for example, if there is a desire to mute a subset of the transmitted speech signals, such as if certain signals are not to be heard by a particular group of teleconference participants, or if isolated speech signals are required for feeding into automatic translation systems.

Figure 5:
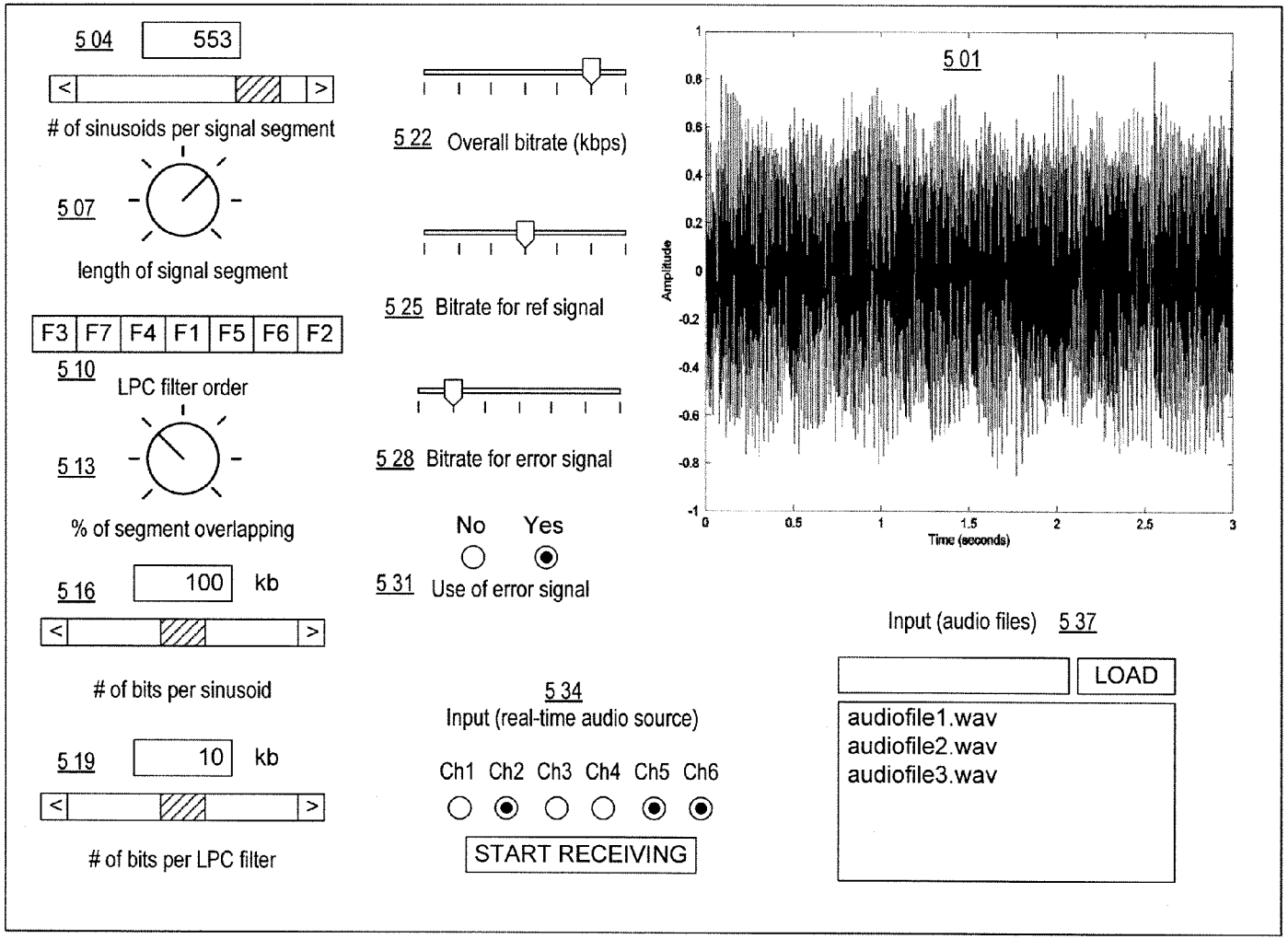
FIG. 5 shows an implementation of an encoding-side user interface in one embodiment of APT operation.

FIG. 5 shows an implementation of an encoding-side user interface (UI) in one embodiment of APT operation. The implementation shown includes a display screen 501 which may be configurable to display an audio signal, signal sample, time-domain and/or frequency-domain signal, error signal, and/or the like, as well as system messages, menus, and/or the like. In one implementation, the display screen may admit touch-screen inputs. The illustrated UI further includes a variety of interface widgets configurable to receive user inputs and/or selections which may be stored and/or may alter, influence, and/or control various aspects of APT audio processing. A slider widget is shown at 504, by which the number of sinusoids used to model each signal segment may be controlled. A dial widget is shown at 507, by which the segment length (e.g., 20 milliseconds) for each signal segment may be controlled. A drag-and-drop block widget is shown at 510, by which the order of LPC filters (F1-F7 in the illustrated implementation) may be selected and/or varied. A dial widget is shown at 513, by which the percentage overlap of different segments may be varied. A slider widget is shown at 516, by which the number of bits per sinusoid used in the sinusoidal model may be varied. A slider widget is shown at 519, by which the number of bits per LPC filter may be varied. Slider widgets are also shown at 522, 525, and 528, by which the overall bitrate (in kbps), bitrate for the reference signal, and bitrate for the error signal may respectively be adjusted. At 531, radio button widgets are shown by which a user may set whether or not the APT system is to include an error signal in the side information and/or the resulting encoded signal. The illustrated UI implementation also allows a user to set how audio data is to be input into the APT system. At 534, a series of radio buttons allow a user to specify one or more channels from which audio data feeds, real-time recordings, and/or the like may be received. The illustrated implementation allows only up to six channels, however an alternative implementation may allow as many channels as needed and/or desired by an APT system, user, administrator, and/or the like. The illustrated UI implementation also includes, at 537, a window in which to specify one or more audio data files to load for APT processing.

APT Controller

Figure 6:
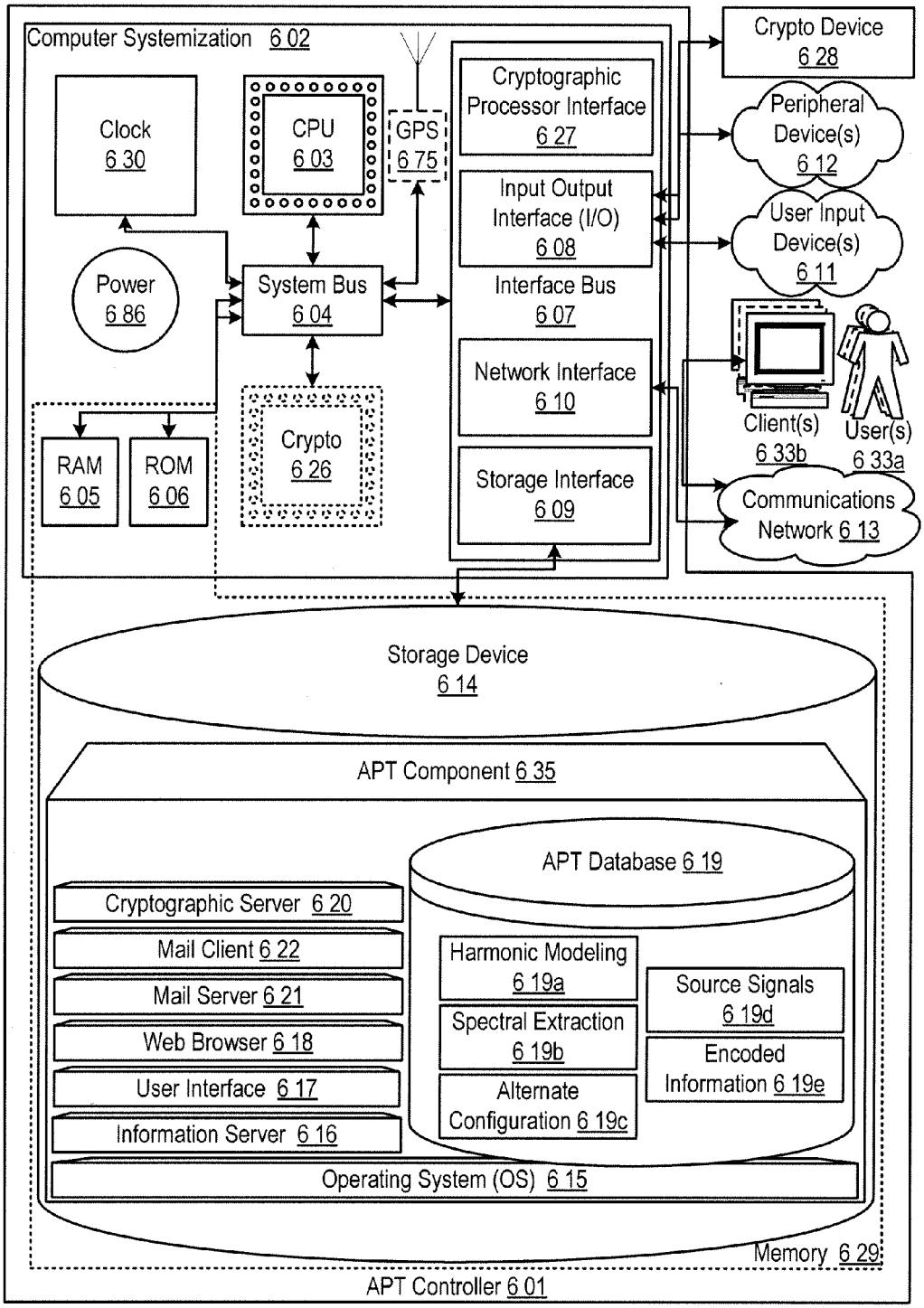
FIG. 6 is of a block diagram illustrating embodiments of the present invention of an Audio Processing/Transmission controller.

FIG. 6 of the present disclosure illustrates inventive aspects of a APT controller 601 in a block diagram. In this embodiment, the APT controller 601 may serve to aggregate, process, store, search, serve, identify, instruct, generate, match, and/or facilitate interactions with a computer through various technologies, and/or other related data.

Typically, users, which may be people and/or other systems, engage information technology systems (e.g., commonly computers) to facilitate information processing. In turn, computers employ processors to process information; such processors are often referred to as central processing units (CPUs). A common form of processor is referred to as a microprocessor. CPUs use communicative signals to enable various operations. Such communicative signals may be stored and/or transmitted in batches as program and/or data components facilitate desired operations. These stored instruction code signals may engage the CPU circuit components to perform desired operations. A common type of program is a computer operating system, which, commonly, is executed by CPU on a computer; the operating system enables and facilitates users to access and operate computer information technology and resources. Common resources employed in information technology systems include: input and output mechanisms through which data may pass into and out of a computer; memory storage into which data may be saved; and processors by which information may be processed. Often information technology systems are used to collect data for later retrieval, analysis, and manipulation, commonly, which is facilitated through a database program. Information technology systems provide interfaces that allow users to access and operate various system components.

In one embodiment, the APT controller 601 may be connected to and/or communicate with entities such as, but not limited to: one or more users from user input devices 611; peripheral devices 612; a cryptographic processor device 628; DSP components 629, and/or a communications network 613.

Networks are commonly thought to comprise the interconnection and interoperation of clients, servers, and intermediary nodes in a graph topology. It should be noted that the term "server" as used throughout this disclosure refers generally to a computer, other device, program, or combination thereof that processes and responds to the requests of remote users across a communications network. Servers serve their information to requesting "clients." The term "client" as used herein refers generally to a computer, other device, program, or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The APT controller 601 may be based on common computer systems that may comprise, but are not limited to, components such as: a computer systemization 602 connected to memory 629.

Computer Systemization

A computer systemization 602 may comprise a clock 630, central processing unit (CPU) 603, a read only memory (ROM) 606, a random access memory (RAM) 605, and/or an interface bus 607, and most frequently, although not necessarily, the foregoing are all interconnected and/or communicating through a system bus 604. Optionally, the computer systemization may be connected to an internal power source 686. Optionally, a cryptographic processor 626 and/or a global positioning system (GPS) unit 676 may be connected to the system bus. The system clock typically has a crystal oscillator and provides a base signal. The clock is typically coupled to the system bus and various clock multipliers that will increase or decrease the base operating frequency for other components interconnected in the computer systemization. The clock and various components in a computer systemization drive signals embodying information throughout the system. Such transmission and reception of signals embodying information throughout a computer systemization may be commonly referred to as communications. These communicative signals may further be transmitted, received, and the cause of return and/or reply signal communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. The CPU may be a microprocessor such as AMD's Athlon, Duron and/or Opteron; IBM and/or Motorola's PowerPC; IBM's and Sony's Cell processor; Intel's Celeron, Itanium, Pentium, Xeon, and/or XScale; and/or the like processor(s). The CPU interacts with memory through signal passing through conductive conduits to execute stored signal program code according to conventional data processing techniques. Such signal passing facilitates communication within the APT controller and beyond through various interfaces. Should processing requirements dictate a greater amount speed, parallel, mainframe and/or super-computer architectures may similarly be employed. Alternatively, should deployment requirements dictate greater portability, smaller Personal Digital Assistants (PDAs) may be employed.

Power Source

The power source 686 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 686 is connected to at least one of the interconnected subsequent components of the APT thereby providing an electric current to all subsequent components. In one example, the power source 686 is connected to the system bus component 604. In an alternative embodiment, an outside power source 686 is provided through a connection across the I/O 608 interface. For example, a USB and/or IEEE 1394 connection carries both data and power across the connection and is therefore a suitable source of power.

Interface Adapters

Interface bus(es) 607 may accept, connect, and/or communicate to a number of interface adapters, conventionally although not necessarily in the form of adapter cards, such as but not limited to: input output interfaces (I/O) 608, storage interfaces 609, network interfaces 610, and/or the like. Optionally, cryptographic processor interfaces 627 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 609 may accept, communicate, and/or connect to a number of storage devices such as, but not limited to: storage devices 614, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 610 may accept, communicate, and/or connect to a communications network 613. Through a communications network 613, the APT controller is accessible through remote clients 633*b* (e.g., computers with web browsers) by users 633*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 610 may be used to engage with various communications network types 613. For example, multiple network interfaces may be employed to allow for the communication over broadcast, multicast, and/or unicast networks.

Input Output interfaces (I/O) 608 may accept, communicate, and/or connect to user input devices 611, peripheral devices 612, cryptographic processor devices 628, and/or the like. I/O may employ connection protocols such as, but not limited to: Apple Desktop Bus (ADB); Apple Desktop Connector (ADC); audio: analog, digital, monaural, RCA, stereo, and/or the like; IEEE 1394a-b; infrared; joystick; keyboard; midi; optical; PC AT; PS/2; parallel; radio; serial; USB; video interface: BNC, coaxial, composite, digital, Digital Visual Interface (DVI), RCA, RF antennae, S-Video, VGA, and/or the like; wireless; and/or the like. A common output device is a television set, which accepts signals from a video interface. Also, a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Typically, the video interface provides the composited video information through a video connection interface that accepts a video display interface (e.g., an RCA composite video connector accepting an RCA composite video cable; a DVI connector accepting a DVI display cable, etc.).

User input devices 611 may be card readers, dongles, finger print readers, gloves, graphics tablets, joysticks, keyboards, mouse (mice), remote controls, retina readers, trackballs, trackpads, and/or the like.

Peripheral devices 612 may be connected and/or communicate to I/O and/or other facilities of the like such as network interfaces, storage interfaces, and/or the like. Peripheral devices may be audio devices, cameras, dongles (e.g., for copy protection, ensuring secure transactions with a digital signature, and/or the like), external processors (for added functionality), goggles, microphones, monitors, network interfaces, printers, scanners, storage devices, video devices, video sources, visors, and/or the like.

It should be noted that although user input devices and peripheral devices may be employed, the APT controller may be embodied as an embedded, dedicated, and/or monitor-less (i.e., headless) device, wherein access would be provided over a network interface connection.

Cryptographic units such as, but not limited to, microcontrollers, processors 626, interfaces 627, and/or devices 628 may be attached, and/or communicate with the APT controller. A MC68HC16 microcontroller, commonly manufactured by Motorola Inc., may be used for and/or within cryptographic units. Equivalent microcontrollers and/or processors may also be used. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Other commercially available specialized cryptographic processors include VLSI Technology's 33 MHz 6868 or Semaphore Communications' 40 MHz Roadrunner 184.

Some implementations of the APT may be configured with DSP Components 629 that are configured and used to achieve a variety of features or signal processing. Depending on the particular implementation, the DSP components may include software solutions, hardware solutions, or some combination of both hardware/software solutions. As an example, the DSP components may be configured as a Multi-Input Hardware MPEG4/H.264 Video Encoder PCI card family, such as Inventa's S26X, that can be used in various data processing applications such as high-quality realtime video & audio capture/processing applications. In another embodiment, a SoundBlaster Live sound card may be used by various APT components for both DSP features and/or audio output features.

Implementations of the APT, as well as aspects of the APT features discussed herein may be achieved through implementing the APT (or components of the APT) as field-programmable gate arrays (FPGAs), which are a semiconductor devices containing programmable logic components called "logic blocks", and programmable interconnects, such as the high performance FPGA Virtex series and/or the low cost Spartan series manufactured by Xilinx. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory.

A hierarchy of programmable interconnects allows logic blocks to be interconnected as needed by the APT system designer, somewhat like a one-chip programmable breadboard. Logic blocks and interconnects can be programmed by the customer or designer, after the FPGA is manufactured, to implement any logical function. Alternate or coordinating implementations may implement APT features on application-specific integrated circuit (ASIC), instead of or in addition to FPGAs. The APT designs may be developed on regular FPGAs and then migrated into a fixed version that more resembles an ASIC implementations.

Memory

Generally, any mechanization and/or embodiment allowing a processor to affect the storage and/or retrieval of information is regarded as memory 629. However, memory is a fungible technology and resource, thus, any number of memory embodiments may be employed in lieu of or in concert with one another. It is to be understood that the APT controller and/or a computer systemization may employ various forms of memory 629. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 629 will include ROM 606, RAM 605, and a storage device 614. A storage device 614 may be any conventional computer system storage. Storage devices may include a drum; a (fixed and/or removable) magnetic disk drive; a magneto-optical drive; an optical drive (i.e., CD ROM/RAM/Recordable (R), ReWritable (RW), DVD R/RW, etc.); an array of devices (e.g., Redundant Array of Independent Disks (RAID)); and/or other devices of the like. Thus, a computer systemization generally requires and makes use of memory.

Component Collection

The memory 629 may contain a collection of program and/or database components and/or data such as, but not limited to: operating system component(s) 615 (operating system); information server component(s) 616 (information server); user interface component(s) 617 (user interface); Web browser component(s) 618 (Web browser); database(s) 619; mail server component(s) 621; mail client component(s) 622; cryptographic server component(s) 620 (cryptographic server); the APT component(s) 635; and/or the like (i.e., collectively a component collection). These components may be stored and accessed from the storage devices and/or from storage devices accessible through an interface bus. Although non-conventional program components such as those in the component collection, typically, are stored in a local storage device 614, they may also be loaded and/or stored in memory such as: peripheral devices, RAM, remote storage facilities through a communications network, ROM, various forms of memory, and/or the like.

Operating System

The operating system component 615 is an executable program component facilitating the operation of the APT controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the APT controller to communicate with other entities through a communications network 613. Various communication protocols may be used by the APT controller as a subcarrier transport mechanism for interaction, such as, but not limited to: multicast, TCP/IP, UDP, unicast, and/or the like.

Information Server

An information server component 616 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, Java, JavaScript, Practical Extraction Report Language (PERL), Hypertext Pre-Processor (PHP), pipes, Python, WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the APT controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the APT database 619, operating systems, other program components, user interfaces, Web browsers, and/or the like.

Access to the APT database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the APT. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the APT as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/Vista (i.e., Aero)/XP, or Unix's X-Windows (e.g., which may include additional Unix graphic interface libraries and layers such as K Desktop Environment (KDE), mythTV and GNU Network Object Model Environment (GNOME)), provide a baseline and means of accessing and displaying information graphically to users.

A user interface component 617 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 618 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Some Web browsers allow for the execution of program components through facilities such as Java, JavaScript, ActiveX, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the APT enabled nodes. The combined application may be nugatory on systems employing standard Web browsers.

Mail Server

A mail server component 621 is a stored program component that is executed by a CPU 603. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the APT.

Access to the APT mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 622 is a stored program component that is executed by a CPU 603. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses.

Generally, the mail client provides a facility to compose and transmit electronic mail messages.

Cryptographic Server

A cryptographic server component 620 is a stored program component that is executed by a CPU 603, cryptographic processor 626, cryptographic processor interface 627, cryptographic processor device 628, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X. 609 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Inte et encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the APT may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the APT component to engage in secure transactions if so desired. The cryptographic component facilitates the secure accessing of resources on the APT and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The APT Database

The APT database component 619 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the APT database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the APT database is implemented as a data-structure, the use of the APT database 619 may be integrated into another component such as the APT component 635. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 619 includes several tables 619*a-e*. A Harmonic Modeling table 619*a* may include fields such as, but not limited to: various models for the APT sinusoidal extraction components, and/or the like. A Spectral Extraction table 619*b* may include fields such as, but not limited to: various models for the APT spectral extraction components and/or the like. An Alternate Configuration table 619*c* may include fields such as, but not limited to: additional models for different configurations of the ATP System-DSP component interactions. A Source Signals table 619*d* may include fields such as, but not limited to: source signal(s), preferred mix levels, source signal types, and/or the like. An Encoded Information table 619*e* may include fields such as, but not limited to: harmonic model parameters, spectral envelopes, noise powers, reference signals, preferred mixing levels, source signal types, and/or the like. These and/or other tables may support and/or track multiple entity accounts on and/or within the APT system.

In one embodiment, the APT database may interact with other database systems. For example, employing a distributed database system, queries and data access by search APT component may treat the combination of the APT database, an integrated data security layer database as a single database entity.

In one embodiment, user programs may contain various user interface primitives, which may serve to update the APT. Also, various accounts may require custom database tables depending upon the environments and the types of clients the APT may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 619*a-e*. The APT may be configured to keep track of various settings, inputs, and parameters via database controllers.

The APT database may communicate to and/or with other components in a component collection, including itself, and/or facilities of the like. Most frequently, the APT database communicates with the APT component, other program components, and/or the like. The database may contain, retain, and provide information regarding other nodes and data.

The APT Components

The APT component 635 is a stored program component that is executed by a CPU. In one embodiment, the APT component incorporates any and/or all combinations of the aspects of the APT that was discussed in the previous figures. As such, the APT affects accessing, obtaining and the provision of computations, information, services, transactions, and/or the like across various communications networks.

The APT component enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, WebObjects, and/or the like. In one embodiment, the APT server employs a cryptographic server to encrypt and decrypt communications. The APT component may communicate to and/or with other components in a component collection, including itself, and/or facilities of the like. Most frequently, the APT component communicates with the APT database, operating systems, other program components, and/or the like. The APT may contain, communicate, generate, obtain, and/or provide program component, system, user, and/or data communications, requests, and/or responses.

Distributed APT Components

The structure and/or operation of any of the APT node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the APT controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), local and remote application program interfaces Jini, Remote Method Invocation (RMI), process pipes, shared files, and/or the like. Messages sent between discrete component components for inter-application communication or within memory spaces of a singular component for intra-application communication may be facilitated through the creation and parsing of a grammar. A grammar may be developed by using standard development tools such as lex, yacc, XML, and/or the like, which allow for grammar generation and parsing functionality, which in turn may form the basis of communication messages within and between components. Again, the configuration will depend upon the context of system deployment.

The entirety of this disclosure (including the Cover Page, Title, Headings, Field, Background, Summary, Brief Description of the Drawings, Detailed Description, Claims, Abstract, Figures, and otherwise) shows by way of illustration various embodiments in which the claimed inventions may be practiced. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the disclosure are not to be considered limitations on the disclosure as defined by the claims or limitations on equivalents to the claims.

What is claimed is:

1. A processor-implemented method for encoding a plurality of audio signals, comprising: segmenting each of the plurality of audio signals into a plurality of audio signal segments; for each audio signal segment: determining a modeled signal segment approximation to the audio signal segment in accordance with a sinusoidal model to extract applicable sinusoidal parameters; subtracting the modeled signal segment approximation from the audio signal segment to generate a sinusoidal error signal; extracting spectral envelope parameters corresponding to a spectral envelope for the sinusoidal error signal in accordance with a spectral envelope model; and removing the spectral envelope for the sinusoidal error signal from the sinusoidal error signal to yield a residual noise signal comprising a whitened version of the sinusoidal error signal; summing a plurality of residual noise signals corresponding to the plurality of audio signals to yield a reference signal; and packaging the reference signal, the applicable sinusoidal parameters, and the spectral envelope parameters in an encoded audio data structure.

2. The method of claim 1, further comprising: storing the encoded audio data structure in a database.

3. The method of claim 1, further comprising: transmitting the encoded audio signal structure to a remote receiver.

4. The method of claim 3, wherein the remote receiver decodes the plurality of audio signals from information contained in the encoded audio data structure to yield a plurality of reconstructed audio signals, and the decoding for each of the plurality of audio signals comprises: constructing a reconstructed sinusoidal error signal by filtering the reference signal using corresponding spectral envelope parameters; constructing a modeled source signal in accordance with the sinusoidal model and corresponding applicable sinusoidal parameters; and summing the reconstructed sinusoidal error signal and modeled source signal to yield a corresponding reconstructed audio signal.

5. The method of claim 4, wherein the reconstructed audio signal corresponds to a segment of an audio, and further comprising: overlap adding reconstructed audio signals corresponding to each audio signal of the plurality of audio signals.

6. The method of claim 4, wherein the reconstructed audio signal corresponds to an entire audio signal of the plurality of audio signals.

7. The method of claim 4, further comprising: mixing the reconstructed audio signals.

8. The method of claim 1, wherein the sinusoidal model comprises a sum of sinusoids.

9. The method of claim 1, wherein the sinusoidal model comprises a short-time Fourier transform.

10. The method of claim 1, wherein the applicable sinusoidal parameters comprise a plurality of sinusoidal parameter triads, and wherein the sinusoidal parameter triads each comprise an amplitude, a frequency, and a phase.

11. The method of claim 1, wherein the spectral envelope model comprises a linear predictive analysis.

12. The method of claim 11, wherein the spectral envelope parameters comprise a noise shaping filter and a noise power.

13. The method of claim 11, wherein the linear predictive analysis comprises a multi-band linear predictive analysis in which a linear predictive analysis is applied separately to each frequency band of each sinusoidal error signal.

14. The method of claim 1, wherein each of the plurality of audio signals comprises a monophonic audio signal.

15. A processor-implemented method for encoding audio information, comprising: receiving a plurality of monophonic audio signals; modeling each monophonic audio signal of the plurality of audio signals by a modeled approximation in accordance with a signal approximation model and retaining a set of model parameters for each modeled approximation; subtracting each modeled approximation from each corresponding monophonic audio signal to obtain an error signal; modeling a spectral envelope for each error signal based on a spectral envelope estimation model and retaining a set of spectral envelope parameters for each spectral envelope; removing the spectral envelope for the error signal from the error signal to yield a residual noise component from each error signal, wherein the residual noise component comprises a whitened version of the error signal; summing the residual noise components to yield a reference signal; and packaging the sets of model parameters, the sets of spectral envelope parameters, and the reference signal in an encoded audio data structure.

16. The method of claim 15, further comprising: dividing each monophonic audio signal into a plurality of audio signal segments; and modeling each of the plurality of audio signal segments by a modeled approximation in accordance with a signal approximation model and retaining a set of model parameters for each modeled approximation, subtracting each modeled approximation from each corresponding audio signal segment to obtain an error signal, modeling a spectral envelope for each error signal based on a spectral envelope estimation model and retaining a set of spectral envelope parameters for each spectral envelope, and extracting a residual noise component from each error signal are performed on a segment-by-segment basis.

17. The method of claim 15, wherein the signal approximation model comprises a sum of sinusoids and each set of model parameters comprises a collection of triads, wherein each triad comprises an amplitude, a frequency, and a phase.

18. The method of claim 15, further comprising: storing the encoded audio data structure in a database.

19. The method of claim 15, further comprising: transmitting the encoded audio signal structure to a remote receiver.

20. The method of claim 19, wherein the remote receiver decodes the plurality of monophonic audio signals from information contained in the encoded audio data structure to yield a plurality of reconstructed audio signals, and the decoding for each of the plurality of monophonic audio signals comprises: constructing a reconstructed error signal by filtering the reference signal using corresponding spectral envelope parameters; constructing a modeled source signal in accordance with the signal approximation model and corresponding model parameters; and summing the reconstructed error signal and modeled source signal to yield a corresponding reconstructed audio signal.

21. The method of claim 20, wherein the reconstructed audio signal corresponds to a segment of a monophonic audio signal, and further comprising: overlap adding reconstructed audio signals corresponding to each monophonic audio signal of the plurality of monophonic audio signals.

22. The method of claim 20, wherein the reconstructed audio signal corresponds to an entire monophonic audio signal of the plurality of monophonic audio signals.

23. The method of claim 20, further comprising: mixing the reconstructed audio signals.

24. The method of claim 15, wherein modeling each monophonic audio signal of the plurality of audio signals by a modeled approximation in accordance with a signal approximation model and retaining a set of model parameters for each modeled approximation includes performing a short-time Fourier transform.

25. The method of claim 15, wherein the spectral envelope estimation model comprises a linear predictive analysis.

26. The method of claim 25, wherein the set of spectral envelope parameters comprise a noise shaping filter and a noise power.

27. The method of claim 25, wherein the linear predictive analysis comprises a multi-band linear predictive analysis in which a linear predictive analysis is applied separately to each frequency band of each error signal.

28. A computer based method for encoding an arbitrary number of source audio signals comprising: for each source audio signal, extracting side information from the source audio signal using a parametric model representing at least deterministic and stochastic components of the source audio signal, wherein the side information includes sinusoidal parameters of the source audio signal and a spectral envelope of the stochastic components of the source audio signal; taking a difference between the source audio signal and a modeled audio signal constructed according to the parametric model and the side information to yield a residual source audio signal representing the stochastic components of the source audio signal after the spectral envelope of the stochastic components has been removed; and summing all residual source audio signals to yield a reference signal, wherein the reference signal is capable of being used together with the side information corresponding to each source audio signal to reproduce the source audio signal.

29. A system for encoding audio information, comprising: a processor; a memory in communication with the processor and containing program instructions; an input and output in communication with the processor and memory; wherein the processor executes program instructions contained in the memory and the program instructions comprise: receive a plurality of monophonic audio signals; model each monophonic audio signal of the plurality of audio signals by a harmonic approximation and retain a set of sinusoidal parameters for each harmonic approximation; subtract each harmonic approximation from each corresponding monophonic audio signal to obtain an error signal; model a spectral envelope for each error signal based on a spectral envelope estimation model and retain a set of spectral envelope parameters for each spectral envelope; remove the spectral envelope for the error signal from the error signal to yield a residual noise component from each error signal, wherein the residual noise component comprises a whitened version of the error signal; sum the residual noise components to yield a reference signal; and package the sets of sinusoidal parameters, the sets of spectral envelope parameters, and the reference signal in an encoded audio data structure.

30. A processor-accessible medium for encoding audio information, comprising: processor readable instructions stored in the processor-accessible medium, wherein the processor readable instructions are issuable by a processor to: receive a plurality of monophonic audio signals; model each monophonic audio signal of the plurality of audio signals by a harmonic approximation and retaining a set of sinusoidal parameters for each harmonic approximation; subtract each harmonic approximation from each corresponding monophonic audio signal to obtain an error signal; model a spectral envelope for each error signal based on a spectral envelope estimation model and retaining a set of spectral envelope parameters for each spectral envelope; remove the spectral envelope for the error signal from the error signal to yield a residual noise component from each error signal, wherein the residual noise component comprises a whitened version of the error signal; sum the residual noise components to yield a reference signal; and package the sets of sinusoidal parameters, the sets of spectral envelope parameters, and the reference signal in an encoded audio data structure.

* * * * *